US009786997B2

(12) United States Patent
Schwengler et al.

(10) Patent No.: US 9,786,997 B2
(45) Date of Patent: Oct. 10, 2017

(54) WIRELESS ACCESS POINT IN PEDESTAL OR HAND HOLE

(71) Applicant: CenturyLink Intellectual Property LLC, Denver, CO (US)

(72) Inventors: Thomas Schwengler, Lakewood, CO (US); John M. Heinz, Olathe, KS (US); Michael L. Elford, Calhoun, LA (US)

(73) Assignee: CenturyLink Intellectual Property LLC, Denver, CO (US)

( * ) Notice: Subject to any disclaimer, the term of this patent is extended or adjusted under 35 U.S.C. 154(b) by 416 days.

(21) Appl. No.: 14/316,665

(22) Filed: Jun. 26, 2014

(65) Prior Publication Data

US 2015/0035704 A1 Feb. 5, 2015

Related U.S. Application Data

(60) Provisional application No. 61/861,216, filed on Aug. 1, 2013.

(51) Int. Cl.

| | |
|---|---|
| ***H01Q 1/22*** | (2006.01) |
| ***H01Q 21/28*** | (2006.01) |
| ***H01Q 1/50*** | (2006.01) |

(52) U.S. Cl.

CPC ..... *H01Q 21/28* (2013.01); *H01Q 1/2291* (2013.01); *H01Q 1/50* (2013.01); *Y10T 29/49018* (2015.01)

(58) Field of Classification Search

CPC ..... H01Q 1/04; H01Q 1/2291; H01Q 1/22; H01Q 1/50; H01Q 21/28

(Continued)

(56) References Cited

U.S. PATENT DOCUMENTS

| | | | |
|---|---|---|---|
| 2,754,101 | A | 7/1956 | Haworth et al. |
| 4,034,567 | A | 7/1977 | Roggen |

(Continued)

FOREIGN PATENT DOCUMENTS

| | | |
|---|---|---|
| CA | 2337284 | 8/2002 |
| FR | 2750717 | 1/1998 |

(Continued)

OTHER PUBLICATIONS

U.S. Appl. No. 14/209,754; Non-Final Rejection dated Jan. 13, 2015; 16 pages.

(Continued)

*Primary Examiner* — Hoang Nguyen
(74) *Attorney, Agent, or Firm* — Swanson & Bratschun, L.L.C.

(57) ABSTRACT

Novel tools and techniques are provided for implementing antenna structures to optimize transmission and reception of wireless signals from ground-based signal distribution devices, which include, but are not limited to, pedestals, hand holes, and/or network access point platforms. Wireless applications with such devices and systems might include, without limitation, wireless signal transmission and reception in accordance with IEEE 802.11a/b/g/n/ac/ad/af standards, UMTS, CDMA, LTE, PCS, AWS, EAS, BRS, and/or the like. In some embodiments, an antenna might be provided within a signal distribution device, which might include a container disposed in a ground surface. A top portion of the container might be substantially level with a top portion of the ground surface. The antenna might be communicatively coupled to one or more of at least one conduit, at least one optical fiber, at least one conductive signal line, or at least one power line via the container.

15 Claims, 16 Drawing Sheets

Fig. 4

(58) Field of Classification Search
USPC ..... 343/719
See application file for complete search history.

(56) References Cited

U.S. PATENT DOCUMENTS

| | | | | |
|---|---|---|---|---|
| 4,329,083 | A | 5/1982 | Parkinson | |
| 4,815,814 | A | 3/1989 | Ulijasz | |
| 5,239,129 | A | 8/1993 | Ehrenfels | |
| 5,313,546 | A | 5/1994 | Toffetti | |
| 5,528,684 | A | 6/1996 | Schneider et al. | |
| 5,566,622 | A | 10/1996 | Ziaylek, Jr. et al. | |
| 5,583,492 | A * | 12/1996 | Nakanishi | G08C 17/02 340/870.01 |
| 5,606,606 | A | 2/1997 | Schneider et al. | |
| 5,760,706 | A * | 6/1998 | Kiss | H04B 7/24 340/10.34 |
| 5,879,109 | A | 3/1999 | Diermeier et al. | |
| 6,099,080 | A | 8/2000 | Hirashita et al. | |
| 6,272,346 | B1 | 8/2001 | Fujinami | |
| 6,371,691 | B1 | 4/2002 | Finzel et al. | |
| 6,499,410 | B1 | 12/2002 | Berardi | |
| 6,503,025 | B1 | 1/2003 | Miller | |
| 6,807,355 | B2 | 10/2004 | Dofher | |
| 6,829,424 | B1 | 12/2004 | Finzel et al. | |
| 6,866,448 | B2 | 3/2005 | Finzel et al. | |
| 6,990,192 | B1 | 1/2006 | Denovich et al. | |
| 7,050,683 | B2 | 5/2006 | Dofher | |
| 7,095,930 | B2 | 8/2006 | Storaasli et al. | |
| 7,514,628 | B2 | 4/2009 | Kadrnoska et al. | |
| 7,522,805 | B2 | 4/2009 | Smith et al. | |
| 7,674,980 | B2 | 3/2010 | Lubanski | |
| 7,740,417 | B2 | 6/2010 | Jang | |
| 7,849,886 | B2 | 12/2010 | Carew et al. | |
| D640,290 | S | 6/2011 | Stellman et al. | |
| 8,061,344 | B2 | 11/2011 | Dofher | |
| 8,480,332 | B2 | 7/2013 | Miller et al. | |
| 9,062,423 | B2 | 6/2015 | Allouche et al. | |
| 9,226,418 | B2 | 12/2015 | Magno et al. | |
| 9,270,098 | B2 | 2/2016 | Isaacks et al. | |
| 9,466,966 | B2 | 10/2016 | Allouche et al. | |
| 9,531,174 | B2 | 12/2016 | Elford et al. | |
| 9,742,172 | B2 | 8/2017 | Elford et al. | |
| 2002/0061231 | A1 | 5/2002 | Finzel et al. | |
| 2003/0123935 | A1 | 7/2003 | Dofher | |
| 2003/0210958 | A1 | 11/2003 | Nothofer | |
| 2004/0115004 | A1 | 6/2004 | Serrano | |
| 2004/0129445 | A1 | 7/2004 | Winkelbach | |
| 2004/0221324 | A1 | 11/2004 | Ansari et al. | |
| 2004/0234215 | A1 | 11/2004 | Serrano et al. | |
| 2005/0013566 | A1 | 1/2005 | Storaasli | |
| 2005/0191113 | A1 | 9/2005 | Frazier | |
| 2005/0191133 | A1 | 9/2005 | Purcell | |
| 2005/0259930 | A1 | 11/2005 | Elkins et al. | |
| 2005/0285807 | A1 * | 12/2005 | Zehngut | H01Q 1/04 343/719 |
| 2006/0008231 | A1 | 1/2006 | Reagan | |
| 2006/0093303 | A1 | 5/2006 | Reagan et al. | |
| 2006/0118338 | A1 | 6/2006 | Maybury | |
| 2006/0204187 | A1 | 9/2006 | Dofher | |
| 2007/0018849 | A1 | 1/2007 | Salser, Jr. | |
| 2007/0154152 | A1 | 7/2007 | Morris | |
| 2008/0298755 | A1 | 12/2008 | Caplan | |
| 2009/0214163 | A1 | 8/2009 | Lu | |
| 2009/0317047 | A1 | 12/2009 | Smith | |
| 2010/0010117 | A1 | 1/2010 | Bricout | |
| 2010/0047021 | A1 | 2/2010 | Scola | |
| 2010/0071596 | A1 | 3/2010 | Konczak | |
| 2010/0086254 | A1 | 4/2010 | Dofher | |
| 2010/0243096 | A1 | 9/2010 | Berglund et al. | |
| 2011/0016754 | A1 | 1/2011 | Ruhl et al. | |
| 2011/0052131 | A1 | 3/2011 | Park et al. | |
| 2011/0315259 | A1 | 12/2011 | Kelly | |
| 2012/0048148 | A1 | 3/2012 | Konczak | |
| 2012/0195694 | A1 | 8/2012 | Konczak | |
| 2013/0011198 | A1 | 1/2013 | Pichler | |
| 2013/0044918 | A1 | 2/2013 | Nielsen et al. | |
| 2013/0216187 | A1 | 8/2013 | Dowling | |
| 2013/0216313 | A1 | 8/2013 | Gustavsson et al. | |
| 2013/0223807 | A1 | 8/2013 | Elford et al. | |
| 2013/0287500 | A1 | 10/2013 | Miller | |
| 2013/0294839 | A1 | 11/2013 | Gustavsson et al. | |
| 2014/0202571 | A1 | 7/2014 | Spijker | |
| 2014/0270971 | A1 | 9/2014 | Allouche | |
| 2014/0327583 | A1 * | 11/2014 | Sparks | H01Q 1/2233 343/702 |
| 2015/0070221 | A1 | 3/2015 | Schwengler et al. | |
| 2015/0110453 | A1 | 4/2015 | Elford et al. | |
| 2015/0139598 | A1 | 5/2015 | Barnes et al. | |
| 2015/0230008 | A1 | 8/2015 | Elford et al. | |
| 2015/0288161 | A1 | 10/2015 | Allouche et al. | |
| 2015/0300527 | A1 | 10/2015 | Konczak | |
| 2016/0109036 | A1 | 4/2016 | Elford et al. | |
| 2016/0109678 | A1 | 4/2016 | Schwengler et al. | |
| 2016/0112779 | A1 | 4/2016 | Barnett, Jr. et al. | |
| 2016/0226231 | A1 | 8/2016 | Elford et al. | |
| 2017/0059802 | A1 | 3/2017 | Elford et al. | |
| 2017/0110784 | A1 | 4/2017 | Vermes et al. | |

FOREIGN PATENT DOCUMENTS

| | | | |
|---|---|---|---|
| GB | 2327680 | A | 2/1999 |
| JP | H03 139705 | A | 6/1991 |
| JP | 10-140507 | | 5/1998 |
| WO | WO 99/61710 | A1 | 12/1999 |
| WO | WO 02/29947 | A1 | 4/2002 |
| WO | WO 2013-130644 | A1 | 9/2013 |

OTHER PUBLICATIONS

U.S. Appl. No. 13/779,488; Final Rejection dated Feb. 9, 2015; 9 pages.
U.S. Appl. No. 14/209,754; Notice of Allowance dated Feb. 18, 2015; 11 pages.
U.S. Appl. No. 13/779,488; Non-final Rejection dated Jun. 11, 2015; 11 pages.
U.S. Appl. No. 14/209,754; Issue Notification dated Jun. 3, 2015; 1 page.
Publication Notice of PCT International Patent Application No. PCT/U/26325; mailed Sep. 25, 2014; 1 page.
U.S. Appl. No. 13/779,488; Non-final Rejection dated Feb. 17, 2016; 13 pages.
U.S. Appl. No. 14/517,574; Non-Final Rejection dated Feb. 26, 2016; 28 pages.
U.S. Appl. No. 14/517,574; Requirement for Restriction dated Jan. 15, 2016; 6 pages.
U.S. Appl. No. 13/779,488; Final Rejection dated May 2, 2016; 7 pages.
U.S. Appl. No. 14/517,574; Final Rejection dated Jun. 16, 2016; 15 pages.
U.S. Appl. No. 14/578,851; Non-Final Rejection dated Jun. 8, 2016; 26 pages.
U.S. Appl. No. 14/746,508; Notice of Allowance dated May 25, 2016; 13 pages.
U.S. Appl. No. 14/973,458; Non-Final Rejection dated Jun. 7, 2016; 25 pages.
International Search Report and Written Opinion prepared by the U.S. Patent and Trademark Office as International Searching Authority for PCT International Patent Application No. PCT/US2013/0280 mailed May 3, 2013; 20 pages.
U.S. Appl. No. 13/779,488; Requirement for Restriction/Election dated May 30, 2014; 5 pages.
U.S. Appl. No. 13/779,488; Non-final Rejection dated Sep. 10, 2014; 11 pages.
International Search Report and Written Opinion prepared by the U.S. Patent and Trademark Office as International Search Authority in PCT International Patent Application No. PCT/US2014/026325, mailed Aug. 8, 2014; 12 pages.
U.S. Appl. No. 13/779,488; Final Rejection dated Sep. 24, 2015; 9 pages.

(56) References Cited

OTHER PUBLICATIONS

PCT International Patent Application No. PCT/US2014/026325, International Preliminary Report on Patentability issued Sep. 15, 2015; 8 pages.
U.S. Appl. No. 14/746,508; Non-Final Rejection dated Dec. 3, 2015; 16 pages.
European Patent Application No. 14768062.3; Extended European Search Report dated Oct. 18, 2016; 5 pages.
U.S. Appl. No. 13/779,488; Notice of Allowance dated Aug. 16, 2016; 16 pages.
U.S. Appl. No. 14/316,676; Non-Final Rejection dated Aug. 10, 2016; 43 pages.
U.S. Appl. No. 14/517,574; Non-Final Rejection dated Oct. 21, 2016; 18 pages.
U.S. Appl. No. 14/746,508; Issue Notification dated Sep. 21, 2016; 1 page.
U.S. Appl. No. 14/746,508; Supplemental Notice of Allowability date Sep. 9, 2016; 3 pages.
U.S. Appl. No. 14/316,676; Non-Final Rejection dated Feb. 14, 2017; 17 pages.
U.S. Appl. No. 14/973,458; Non-Final Rejection dated May 3, 2017; 21 pages.
U.S. Appl. No. 14/578,851; Non-Final Rejection dated May 3, 2017; 19 pages.
U.S. Appl. No. 14/971,243; Notice of Allowance dated Apr. 17, 2017; 23 pages.
U.S. Appl. No. 13/779,488; Issue Notification dated Dec. 7, 2016; 1 page.
U.S. Appl. No. 14/578,851; Non-Final Rejection dated Nov. 17, 2016; 17 pages.
U.S. Appl. No. 14/971,243; Non-Final Rejection dated Dec. 29, 2016; 51 pages.
U.S. Appl. No. 14/973,458; Non-Final Rejection dated Nov. 18, 2016; 21 pages.
U.S. Appl. No. 14/316,676; Notice of Allowance dated May 19, 2017; 12 pages.
U.S. Appl. No. 14/973,470; Non-Final Rejection dated Jul. 3, 2017; 34 pages.
U.S. Appl. No. 15/352,869; Non-Final Rejection dated May 15, 2017; 20 pages.

* cited by examiner

100

300

300

300

300

300

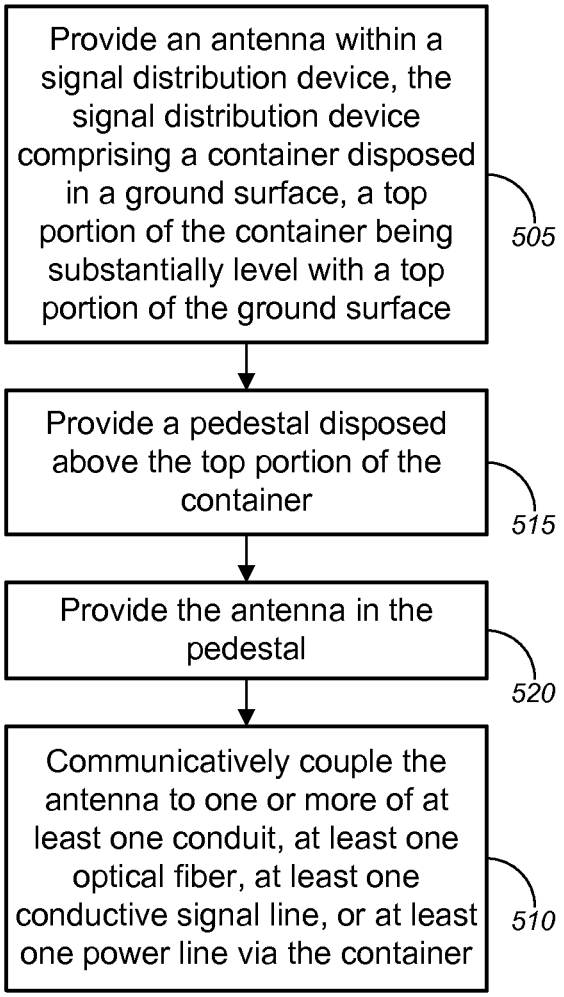
Fig. 5B
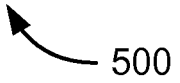

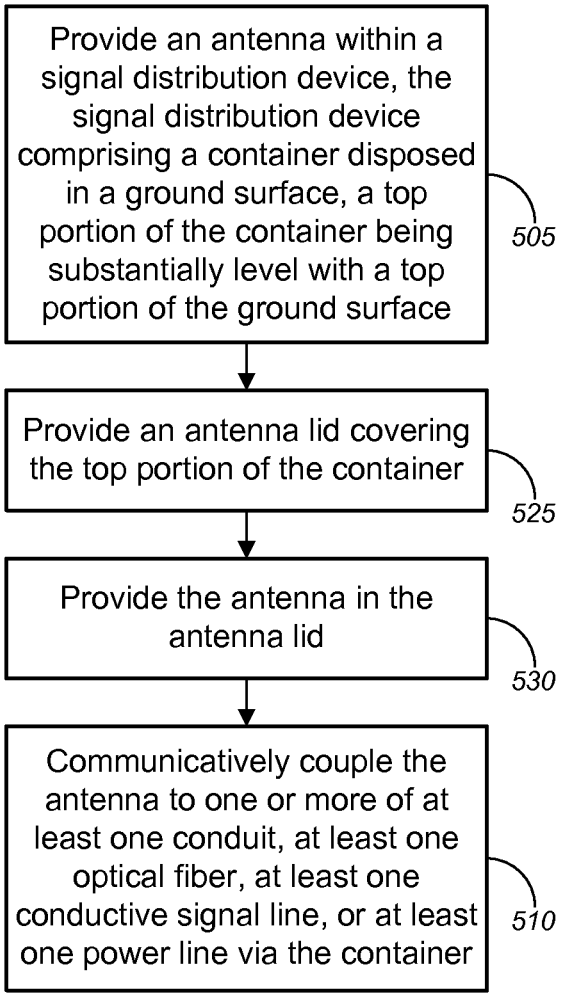
Fig. 5C
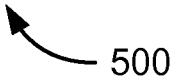

WIRELESS ACCESS POINT IN PEDESTAL OR HAND HOLE

CROSS-REFERENCES TO RELATED APPLICATIONS

This application claims priority to U.S. Patent Application Ser. No. 61/861,216 (the "'216 Application"), filed Aug. 1, 2013 by Thomas Schwengler et al., entitled, "Wireless Access Point in Pedestal or Hand Hole." This application may also be related to U.S. Patent Application Ser. No. 61/874,691, filed Sep. 6, 2013 by Thomas Schwengler et al., entitled, "Wireless Distribution Using Cabinets, Pedestals, and Hand Holes," U.S. patent application Ser. No. 14/316,676, filed on a date even herewith by Thomas Schwengler et al., entitled, "Wireless Distribution Using Cabinets, Pedestals, and Hand Holes." This application may also be related to U.S. Patent Application Ser. No. 61/893,034 (the "'034 Application"), filed Oct. 18, 2013 by Michael L. Elford et al., entitled, "Fiber-to-the-Home (FTTH) Methods and Systems."

The respective disclosures of these applications/patents (which this document refers to collectively as the "Related Applications") are incorporated herein by reference in their entirety for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to methods, systems, and apparatuses for implementing telecommunications signal relays, and, more particularly, to methods, systems, and apparatuses for implementing wireless and/or wired transmission and reception of signals through ground-based signal distribution systems.

BACKGROUND

While a wide variety of wireless access devices are available that rely on access points such as Wi-Fi, and although pedestals and hand holes have been used, the use of wireless access devices has (to the knowledge of the inventors) not as of the filing of the '216 Application been integrated within pedestals or hand holes, or other ground-based signal distribution systems.

Rather, currently available systems for broadband voice, data, and/or video access within customer premises (whether through wired or wireless connection) typically require a physical cable connection (either via optical fiber connection or copper cable connection, or the like) directly to network access devices or optical network terminals located at (in most cases mounted on an exterior wall of) the customer premises, or require satellite transmission of voice, data, and/or video signals to a corresponding dish mounted on the customer premises.

Hence, there is a need for more robust and scalable solutions for implementing wireless and/or wired transmission and reception of signals through ground-based signal distribution devices/systems.

BRIEF SUMMARY

Various embodiments provide tools and techniques for implementing telecommunications signal relays, and, in some embodiments, for implementing wireless and/or wired transmission and reception of signals through ground-based signal distribution devices/systems (including, without limitation, pedestals, hand holes, and/or the like).

In some embodiments, antenna structures might be implemented to optimize transmission and reception of wireless signals from ground-based signal distribution devices, which include, but are not limited to, pedestals, hand holes, and/or network access point platforms, or the like. Wireless applications with such devices and systems might include, without limitation, wireless signal transmission and reception in accordance with IEEE 802.11a/b/g/n/ac/ad/af standards, Universal Mobile Telecommunications System ("UMTS"), Code Division Multiple Access ("CDMA"), Long Term Evolution ("LTE"), Personal Communications Service ("PCS"), Advanced Wireless Services ("AWS"), Emergency Alert System ("EAS"), and Broadband Radio Service ("BRS"), and/or the like. In some embodiments, an antenna might be provided within a signal distribution device, which might include a container disposed in a ground surface. A top portion of the container might be substantially level with a top portion of the ground surface. The antenna might be communicatively coupled to one or more of at least one conduit, at least one optical fiber, at least one conductive signal line, or at least one power line via the container.

Voice, data, and/or video signals to and from the one or more of at least one conduit, at least one optical fiber, at least one conductive signal line, or at least one power line via the container may be wirelessly received and transmitted, respectively, via the antenna to nearby utility poles having wireless transceiver capability, to nearby customer premises (whether commercial or residential), and/or to nearby wireless user devices (such as tablet computers, smart phones, mobile phones, laptop computers, portable gaming devices, and/or the like).

In an aspect, a method might comprise providing an antenna within a signal distribution device, the signal distribution device comprising a container disposed in a ground surface. A top portion of the container might be substantially level with a top portion of the ground surface. The method might further comprise communicatively coupling the antenna to one or more of at least one conduit, at least one optical fiber, at least one conductive signal line (including, but not limited to, data cables, voice cables, video cables, and/or the like, which might include, without limitation, copper data lines, copper voice lines, copper video lines, and/or the like), or at least one power line via the container.

In some embodiments, providing the antenna within the signal distribution device might comprise providing a pedestal disposed above the top portion of the container, and providing the antenna in the pedestal. Alternatively, or additionally, providing the antenna within the signal distribution device might comprise providing an antenna lid covering the top portion of the container, and providing the antenna in the antenna lid. In some instances, the antenna lid might be made of a material that provides predetermined omnidirectional azimuthal radio frequency ("rf") gain. In some alternative, or additional embodiments, providing the antenna within the signal distribution device might comprise providing the antenna in the container, and providing a lid to cover the top portion of the container. The lid might be made of a material that allows for radio frequency ("rf") signal propagation.

According to some embodiments, the antenna might transmit and receive wireless broadband signals according to a set of protocols selected from a group consisting of IEEE 802.11a, IEEE 802.11b, IEEE 802.11g, IEEE 802.11n, IEEE 802.11ac, IEEE 802.11ad, and IEEE 802.11af. In some cases, the antenna might alternatively, or additionally, transmit and receive wireless broadband signals according to a set of protocols selected from a group consisting of Universal Mobile Telecommunications System ("UMTS"), Code Division Multiple Access ("CDMA"), Long Term Evolution ("LTE"), Personal Communications Service ("PCS"), Advanced Wireless Services ("AWS"), Emergency Alert System ("EAS"), and Broadband Radio Service ("BRS").

In another aspect, an apparatus might comprise an antenna disposed within a signal distribution device, the signal distribution device comprising a container disposed in a ground surface. A top portion of the container might be substantially level with a top portion of the ground surface, and the antenna might be communicatively coupled to one or more of at least one conduit, at least one optical fiber, at least one conductive signal line, or at least one power line via the container. The at least one conductive signal line might include, without limitation, data cables, voice cables, video cables, and/or the like, which might include, without limitation, copper data lines, copper voice lines, copper video lines, and/or the like.

Merely by way of example, the apparatus, in some instances, might further comprise a pedestal disposed above the top portion of the container. The antenna might be disposed in the pedestal. In some cases, the pedestal might comprise one of a fiber distribution hub or a network access point. In some embodiments, the pedestal might comprise a pedestal lid and an annular opening. The pedestal lid might be configured to cover the annular opening, in some instances. One of the pedestal lid or the annular opening might comprise a plurality of lateral patch antennas. In some cases, the plurality of lateral patch antennas might comprise a plurality of arrays of patch antennas. According to some embodiments, the pedestal lid might comprise a leaky planar waveguide antenna.

In some embodiments, the apparatus might further comprise an antenna lid covering the top portion of the container. The antenna might be disposed in the antenna lid. In some instances, the antenna lid might comprise a plurality of lateral patch antennas. According to some embodiments, the plurality of lateral patch antennas might comprise a plurality of arrays of patch antennas. In some cases, the antenna lid might comprise a leaky planar waveguide antenna.

In some instances, the apparatus might further comprise a lid covering the top portion of the container. The antenna might be disposed in the container, and the lid might be made of a material that allows for radio frequency ("rf") signal propagation. In some embodiments, the antenna might be in line of sight of one or more wireless transceivers each mounted on an exterior surface of a customer premises of one or more customer premises.

According to some embodiments, the antenna might comprise one or more of at least one additional directing element or at least one additional dielectric layer including a plurality of directing elements. In some cases, the antenna might comprise one or more of at least one reversed F antenna, at least one planar inverted F antenna ("PIFA"), at least one planar waveguide antenna, or at least one lateral patch antenna.

In some embodiments, the antenna might transmit and receive wireless broadband signals according to a set of protocols selected from a group consisting of IEEE 802.11a, IEEE 802.11b, IEEE 802.11g, IEEE 802.11n, IEEE 802.11ac, IEEE 802.11ad, and IEEE 802.11af. In some instances, the antenna might alternatively, or additionally, transmit and receive wireless broadband signals according to a set of protocols selected from a group consisting of Universal Mobile Telecommunications System ("UMTS"), Code Division Multiple Access ("CDMA"), Long Term Evolution ("LTE"), Personal Communications Service ("PCS"), Advanced Wireless Services ("AWS"), Emergency Alert System ("EAS"), and Broadband Radio Service ("BRS").

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

FIGS. 5A-5D are flow diagrams illustrating various methods for implementing wireless and/or wired transmission and reception of signals through ground-based signal distribution devices, in accordance with various embodiments.

DETAILED DESCRIPTION OF CERTAIN EMBODIMENTS

Figure 1:
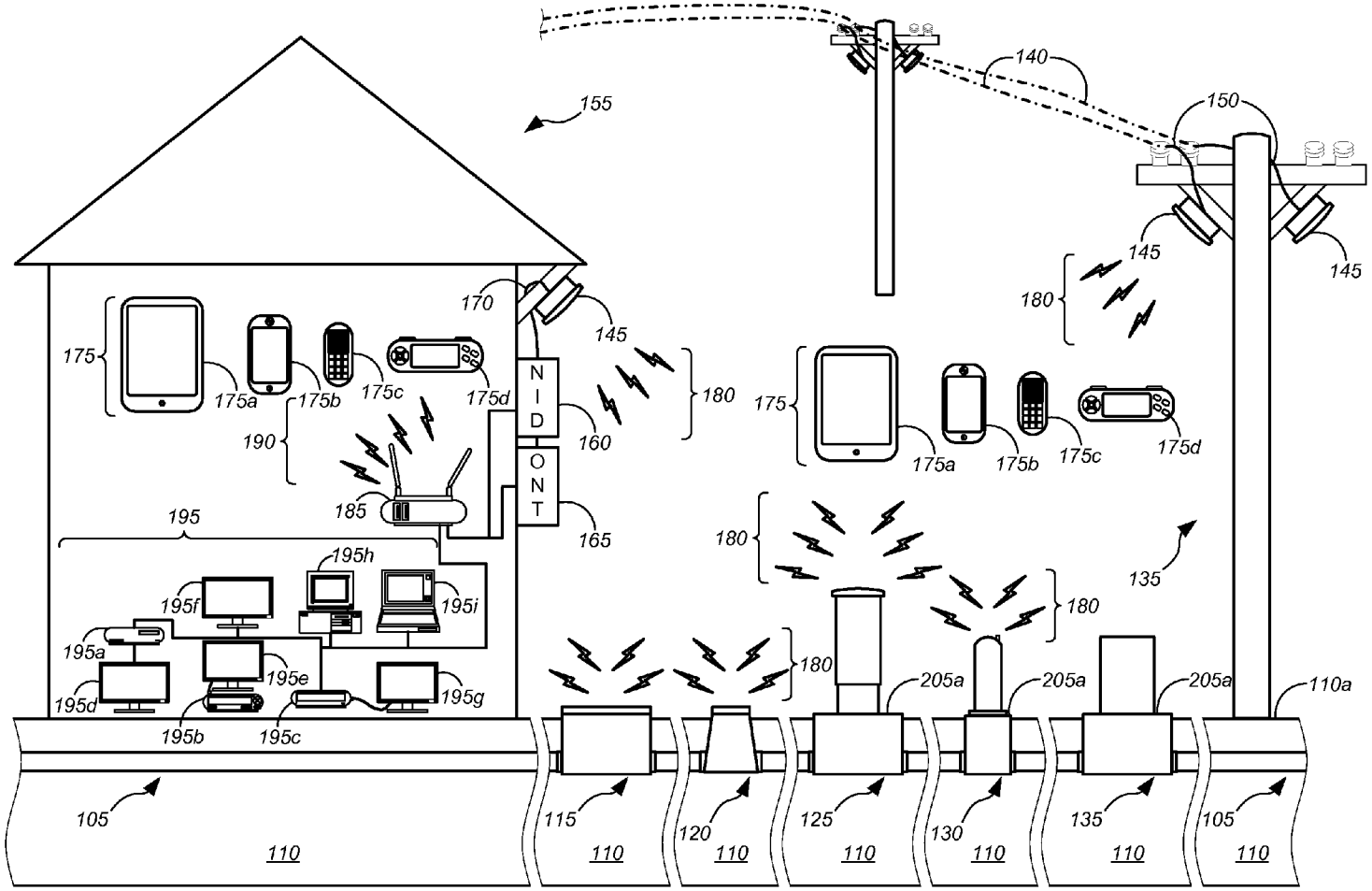
FIG. 1 is a general schematic diagram illustrating a system for implementing wireless and/or wired transmission and reception of signals through ground-based signal distribution devices, in accordance with various embodiments.

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Various embodiments provide tools and techniques for implementing telecommunications signal relays, and, in some embodiments, for implementing wireless and/or wired transmission and reception of signals through ground-based signal distribution devices/systems (including, without limitation, pedestals, hand holes, and/or the like).

In some embodiments, antenna structures might be implemented to optimize transmission and reception of wireless signals from ground-based signal distribution devices, which include, but are not limited to, pedestals, hand holes, and/or network access point platforms. Wireless applications with such devices and systems might include, without limitation, wireless signal transmission and reception in accordance with IEEE 802.11a/b/g/n/ac/ad/af standards, UMTS, CDMA, LTE, PCS, AWS, EAS, BRS, and/or the like. In some embodiments, an antenna might be provided within a signal distribution device, which might include a container disposed in a ground surface. A top portion of the container might be substantially level with a top portion of the ground surface. The antenna might be communicatively coupled to one or more of at least one conduit, at least one optical fiber, at least one conductive signal line, or at least one power line via the container.

Voice, data, and/or video signals to and from the one or more of at least one conduit, at least one optical fiber, at least one conductive signal line, or at least one power line via the container may be wirelessly received and transmitted, respectively, via the antenna to nearby utility poles having wireless transceiver capability, to nearby customer premises (whether commercial or residential), and/or to nearby wireless user devices (such as tablet computers, smart phones, mobile phones, laptop computers, portable gaming devices, and/or the like).

Telecommunications companies have precious assets in the ground, and deploy more. The various embodiments herein utilize these assets and minimal radio infrastructure costs to overlay a fiber or copper plant or network with wireless broadband. In so doing, a cost effective network with wireless broadband may be provided.

In some embodiments, the various embodiments described herein may be applicable to brownfield copper plants, to greenfield fiber roll-outs, and/or the like. Herein, "brownfield" might refer to land on which industrial or commercial facilities are converted (and in some cases decontaminated or otherwise remediated) into residential buildings (or other commercial facilities; e.g., commercial offices, etc.), while "greenfield" might refer to undeveloped land in a city or rural area that is used for agriculture, used for landscape design, or left to naturally evolve.

According to some embodiments, the methods, apparatuses, and systems might be applied to 2.4 GHz and 5 GHz wireless broadband signal distribution as used with today's IEEE 802.11a/b/g/n/ac lines of products. Given the low profile devices, such methods, apparatuses, and systems may also be applicable to upcoming TV white spaces applications (and the corresponding IEEE 802.11af standard). In addition, small cells at 600 MHz and 700 MHz may be well-suited for use with these devices. In some embodiments, higher frequencies can be used such as 60 GHz and the corresponding standard IEEE 802.11ad.

We now turn to the embodiments as illustrated by the drawings. FIGS. 1-5 illustrate some of the features of the method, system, and apparatus for implementing telecommunications signal relays, and, in some embodiments, for implementing wireless and/or wired transmission and reception of signals through ground-based signal distribution devices/systems (including, without limitation, pedestals, hand holes, and/or the like), as referred to above. The methods, systems, and apparatuses illustrated by FIGS. 1-5 refer to examples of different embodiments that include various components and steps, which can be considered alternatives or which can be used in conjunction with one another in the various embodiments. The description of the illustrated methods, systems, and apparatuses shown in FIGS. 1-5 is provided for purposes of illustration and should not be considered to limit the scope of the different embodiments.

With reference to the figures, FIG. 1 is a general schematic diagram illustrating a system 100 for implementing wireless and/or wired transmission and reception of signals through ground-based signal distribution devices, in accordance with various embodiments. In FIG. 1, system 100 might comprise one or more conduits 105 that are embedded or otherwise disposed in the ground 110 (i.e., below a ground surface 110*a*). At least one optical fiber, at least one conductive signal line (including, without limitation, copper data lines, copper voice lines, copper video lines, or any suitable (non-optical fiber) data cables, (non-optical fiber) voice cables, or (non-optical fiber) video cables, and/or the like), at least one power line, and/or the like may be provided within the one or more conduits 105. As shown in FIG. 1, a plurality of ground-based signal distribution devices may be implemented in conjunction with the one or more conduits 105. The plurality of ground-based signal distribution devices might include, without limitation, one or more hand holes 115, one or more flowerpot hand holes 120, one or more pedestal platforms 125, one or more network access point ("NAP") platforms 130, one or more fiber distribution hub ("FDH") platforms 135, and/or the like. Each of these ground-based signal distribution devices may be used to transmit and receive (either wirelessly or via wired connection) data, voice, video, and/or power signals to and from one or more utility poles 135, one or more customer premises 155, and/or one or more mobile user devices 175, or the like. The one or more mobile user devices 175 might include, without limitation, one or more tablet computers 175*a*, one or more smart phones 175*b*, one or more mobile phones 175*c*, one or more portable gaming devices 175*d*, and/or any suitable portable computing or telecommunications device, or the like. The one or more mobile user devices 175 may be located within the one or more customer premises 155 or exterior to the one or more customer premises 155 when in wireless communication with (or when otherwise transmitting and receiving data, video, and/or voice signals to and from) the one or more of the ground-based signal distribution devices, as shown by the plurality of lightning bolts 180 and 190.

According to some embodiments, the one or more utility poles 135 might include or support voice, video, and/or data lines 140. In some cases, the one or more utility poles 135 might include (or otherwise have disposed thereon) one or more wireless transceivers 145, which might communicatively couple with the voice, video, and/or data lines 140 via wired connection(s) 150. The one or more wireless transceivers 145 might transmit and receive data, video, and/or voice signals to and from the one or more of the ground-based signal distribution devices, as shown by the plurality of lightning bolts 180. In some embodiments, the at least one optical fiber, the at least one conductive signal line (including, but not limited to, copper data lines, copper voice lines, copper video lines, or any suitable (non-optical fiber) data cables, (non-optical fiber) video cables, or (non-optical fiber) voice cables, and/or the like), and/or the like that are provided in the one or more conduits 105 might be routed above the ground surface 110*a* (e.g., via one of the one or more hand holes 115, one or more flowerpot hand holes 120, one or more pedestal platforms 125, one or more network access point platforms 130, one or more fiber distribution hub platforms 135, and/or the like) and up at least one utility pole 135 to communicatively couple with the voice, video, and/or data lines 140. In a similar manner, at least one power line that is provided in the one or more conduits 105 might be routed above the ground surface 110*a* and up the at least one utility pole 135 to electrically couple with a power line(s) (not shown) that is (are) supported by the one or more utility poles 135.

In some embodiments, one or more of the ground-based signal distribution devices might serve to transmit and receive data, video, or voice signals directly to one or more customer premises 155 (including a residence (either single family house or multi-dwelling unit, or the like) or a commercial building, or the like), e.g., via optical fiber line connections to an optical network terminal ("ONT") 165, via conductive signal line connections to a network interface device ("NID") 160, or both, located on the exterior of the customer premises 155. Alternatively, or additionally, a wireless transceiver 145 that is placed on an exterior of the customer premises 155 might communicatively couple to the NID 160, to the ONT 165, or both, e.g., via wired connection 170. In some embodiments, the transceiver 145 might be disposed inside one or both of the NID 160 or ONT 165. The wireless transceiver 145 might communicate wirelessly with (or might otherwise transmit and receive data, video, and/or voice signals to and from) the one or more of the ground-based signal distribution devices, as shown by the plurality of lightning bolts 180. Alternatively, or additionally, a modem or residential gateway ("RG") 185, which is located within the customer premises, might communicate wirelessly with (or might otherwise transmit and receive data, video, and/or voice signals to and from) the one or more of the ground-based signal distribution devices. The RG 185 might communicatively couple with one or more user devices 195, which might include, without limitation, gaming console 195*a*, digital video recording and playback device ("DVR") 195*b*, set-top or set-back box ("STB") 195*c*, one or more television sets ("TVs") 195*d*-195*g*, desktop computer 195*h*, and/or laptop computer 195*i*, or other suitable consumer electronics product, and/or the like. The one or more TVs 195*d*-195*g* might include any combination of a high-definition ("HD") television, an Internet Protocol television ("IPTV"), and a cable television, and/or the like, where one or both of HDTV and IPTV may be interactive TVs. The RG 185 might also wirelessly communicate with (or might otherwise transmit and receive voice, video, and data signals) to at least one of the one or more user devices 175 that are located within the customer premises 155, as shown by the plurality of lightning bolts 190.

Figure 4:
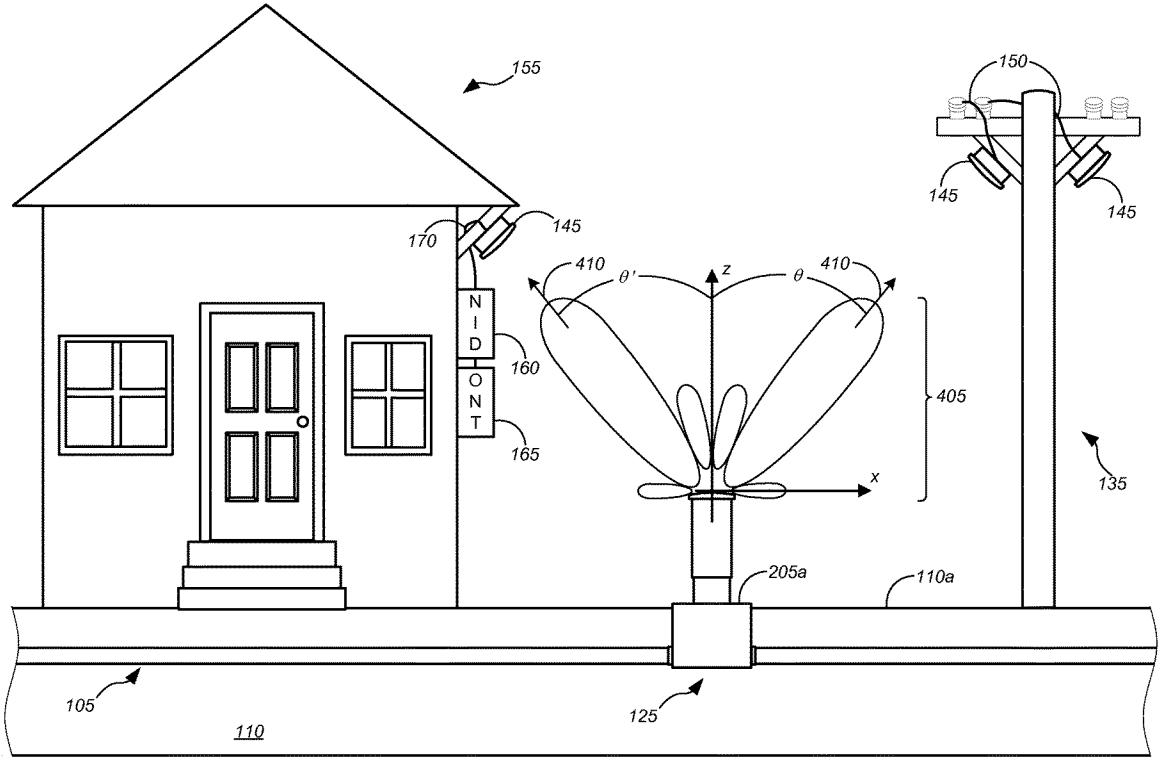
FIG. 4 is a general schematic diagram illustrating an example of radiation patterns for a planar antenna or a planar antenna array(s), as used in a system for implementing wireless and/or wired transmission and reception of signals through ground-based signal distribution devices, in accordance with various embodiments.

As shown in FIGS. 1 and 4, a top surface 205*a* of one or more of the plurality of ground-based signal distribution devices might be set to be substantially level with a top portion of the ground surface 110*a*. This allows for a relatively unobtrusive in-ground telecommunications device, especially with the one or more hand holes 115 and the one or more flowerpot hand holes 120, which might each have only the lid (with minimal portions or no portion of the container portion thereof) exposed above the ground surface 110*a*. For each of the one or more pedestal platforms 125, the one or more NAP platforms 130, the one or more FDH platforms 135, and/or the like, only the pedestal, lid portion, or upper portions remain exposed above the ground surface 110*a*, thus allowing for in-ground telecommunications devices with minimal obtrusion above-ground.

In some embodiments, the antenna in each of the one or more hand holes 115, one or more flowerpot hand holes 120, one or more pedestal platforms 125, one or more NAP platforms 130, one or more FDH platforms 135, one or more wireless transceivers 145, NID 160, ONT 165, one or more mobile user devices 175, RG 185, one or more user devices 195, and/or the like might transmit and receive wireless broadband signals according to a set of protocols/standards selected from a group consisting of IEEE 802.11a, IEEE 802.11b, IEEE 802.11g, IEEE 802.11n, IEEE 802.11ac, IEEE 802.11ad, and IEEE 802.11af. In some cases, such antenna might alternatively, or additionally, transmit and receive wireless broadband signals according to a set of protocols/standards selected from a group consisting of Universal Mobile Telecommunications System ("UMTS"), Code Division Multiple Access ("CDMA"), Long Term Evolution ("LTE"), Personal Communications Service ("PCS"), Advanced Wireless Services ("AWS"), Emergency Alert System ("EAS"), and Broadband Radio Service ("BRS").

Figure 2A:
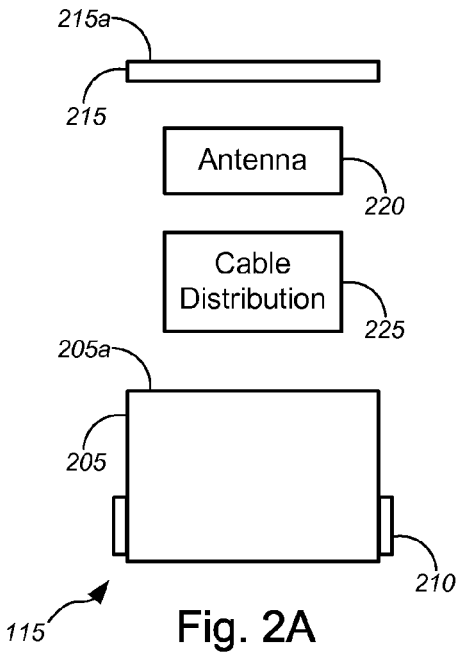
FIGS. 2A-2M are general schematic diagrams illustrating various ground-based signal distribution devices, in accordance with various embodiments.
Figure 2B:
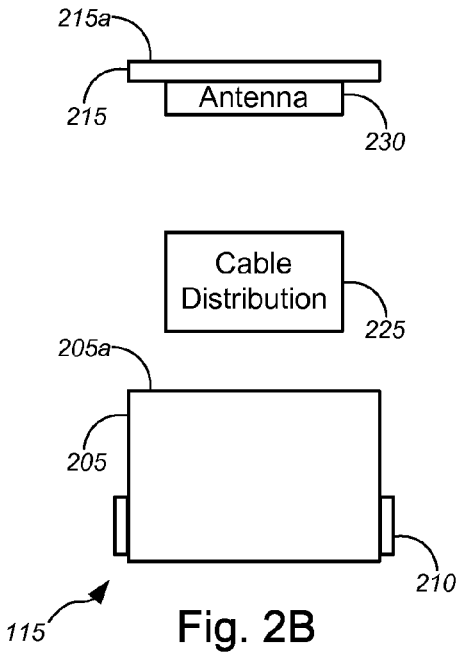
Figure 2C:
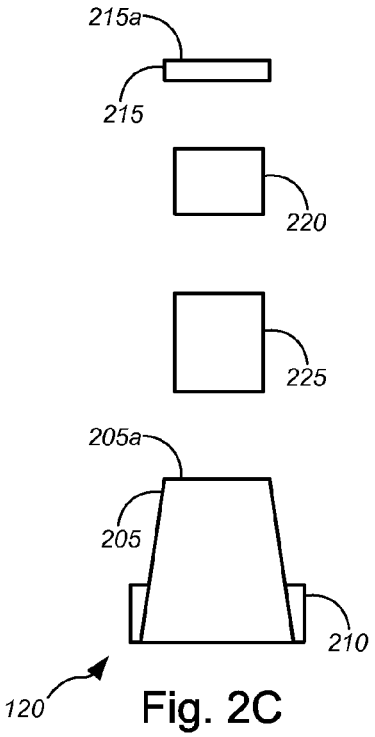
Figure 2D:
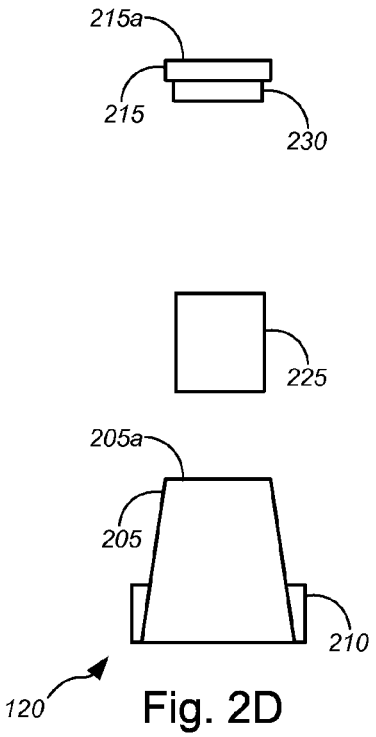

Turning to FIGS. 2A-2M (collectively, "FIG. 2"), general schematic diagrams are provided illustrating various ground-based signal distribution devices (which are shown in, and described with respect to, FIG. 1), in accordance with various embodiments. In particular, FIGS. 2A-2B show various embodiments of the one or more hand holes 115, while FIGS. 2C-2D show various embodiments of the one or more flowerpot hand holes 120. FIGS. 2E-2K show various embodiments of the one or more pedestal platforms 125. FIG. 2L shows an embodiment of the one or more NAP platforms 130, while FIG. 2M shows an embodiment of the one or more FDH platforms 135.

In FIG. 2A, an embodiment of hand hole 115 is shown, which comprises a container 205, at least one conduit port 210, a lid 215, an antenna 220, and a cable distribution system 225. The container 205 might include a square or rectangular box that is made of a material that can durably and resiliently protect contents thereof while being disposed or buried in the ground 110 (i.e., disposed or buried under ground surface 110*a*), and especially against damage caused by shifting ground conditions (such as by expansive soils, tremors, etc.). The container 205 is ideally constructed to be waterproof to protect electronics components disposed therein. The antenna 220 is configured to be disposed or mounted within the interior of the container 205, and can include any suitable antenna, antenna array, or arrays of antennas, as described in detail with respect to FIG. 3, or any other suitable antenna, antenna array, or arrays of antennas. The lid 215 is ideally made of a material that provides predetermined omnidirectional azimuthal rf gain.

The at least one conduit port 210 (shown as two conduit ports in FIGS. 1, 2, and 4) are configured to sealingly connect with the one or more conduits 105. In this manner, the at least one optical fiber, the at least one conductive signal line (including, but not limited to, copper data lines, copper voice lines, copper video lines, or any suitable (non-optical fiber) data cables, (non-optical fiber) video cables, or (non-optical fiber) voice cables, and/or the like), and/or the like that are provided in the one or more conduits 105 might be routed through the at least one conduit port 210 and into the interior of the container 205, to be correspondingly communicatively coupled to the antenna 220 via cable distribution system 225. Cable distribution system 225 may also be configured to route (via container 205) the at least one power line that is provided in the one or more conduits 105 to appropriate power receptacles or power relay systems that are located above ground surface 110*a*.

FIG. 2B shows another embodiment of hand hole 115. In FIG. 2B, the hand hole 115 comprises antenna 230, which is part of lid 215, either disposed completely within the lid 215, disposed below (but mounted to) the lid 215, or disposed partially within the lid 215 and partially extending below the lid 215. Hand hole 115 in FIG. 2B is otherwise similar, or identical to, and has similar, or identical functionalities, as hand hole 115 shown in, and described with respect to, FIG. 2A. Accordingly, the descriptions of the hand hole 115 of FIG. 2A are applicable to the hand hole 115 of FIG. 2B.

FIGS. 2C and 2D show two embodiments of flowerpot hand holes 120. The differences between the hand holes 115 of FIGS. 2A and 2B and the flowerpot hand holes 120 of FIGS. 2C and 2D include a more compact structure (and a correspondingly compact set of antenna(s) 220, antenna(s) 230, and cable distribution systems 225), a container 205 having a generally cylindrical or conical shape (not unlike a flower pot for planting flowers), a lid 215 having a generally circular shape to fit the generally cylindrical or conical container 205, and the like. The flowerpot hand holes 120 are otherwise similar, or identical to, and have similar, or identical, functionalities as hand holes 115 of FIGS. 2A and 2B, respectively. Accordingly, the descriptions of hand holes 115 of FIGS. 2A and 2B are respectively applicable to the flowerpot hand holes 120 of FIGS. 2C and 2D.

According to some embodiments, a wide range of hand holes (some including the hand holes 115 and 120 above) may be used, with polymer concrete lids of various shapes and sizes. In some cases, all splicing can be performed below ground surface 110*a* and no pedestal is added. In some instances, some splicing (e.g., using cable distribution system 225, or the like) can be performed above ground surface 110*a*, such as in pedestal platforms 125 (shown in FIGS. 2E-2K), NAP platforms 130 (shown in FIG. 2L), FDH platforms 135 (shown in FIG. 2M), and/or the like.

In some embodiments, if the hand hole is not placed in a driveway or sidewalk, or the like, the lid 215 (as shown in FIGS. 2A-2D) may be replaced by a pedestal lid 215 (such as shown in FIGS. 2G-2J), or the like. In other words, a small (i.e., short) radio-only pedestal (or pedestal lid) can be added, with no need for any splice tray or the like, just a simple antenna structure. The result might look like a few-inch high (i.e., a few-centimeter high) pedestal with antenna structures as described below with respect to FIGS. 2K and 3A-3K. An advantage with this approach is that the radio pedestal can be easily replaced, maintained, or the like, as it contains only the radio element.

Merely by way of example, in some instances, polymer concrete lids (such as used with typical hand holes) may be built with antenna elements in the lids. In particular, a ground plane can be placed below the lid, and the polymer concrete can be considered a low dielectric constant (i.e., as it has a dielectric constant or relative permittivity $\in_r$ similar to that of air—namely, $\in_r$ of about 1.0). In some cases, patch elements and/or directors may be included within the lid, subject to manufacturing processes.

Alternatively, planar antennas (such as described below with respect to FIGS. 3E-3H) may be placed below the lid, with the concrete surface having negligible impact on radio frequency propagation. A low elevation (i.e., below street level) setting of the radio typically limits the distance of propagation of rf signals. However, architectures having hand holes placed every few customer premises (e.g., homes) in a particular area (i.e., neighborhood) may sufficiently compensate for the limited distance of rf signal propagation.

Figure 2E:
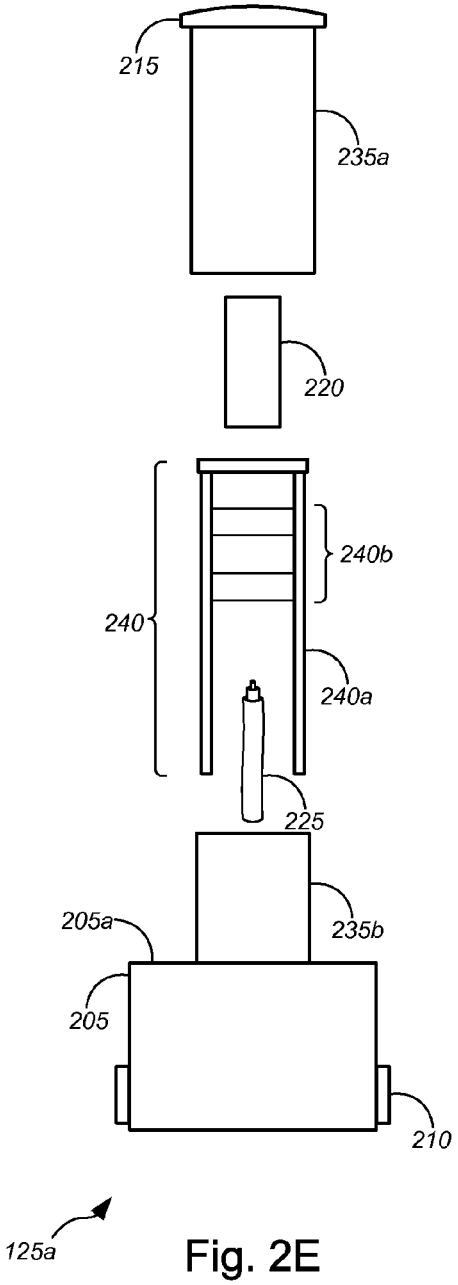
Figure 2F:
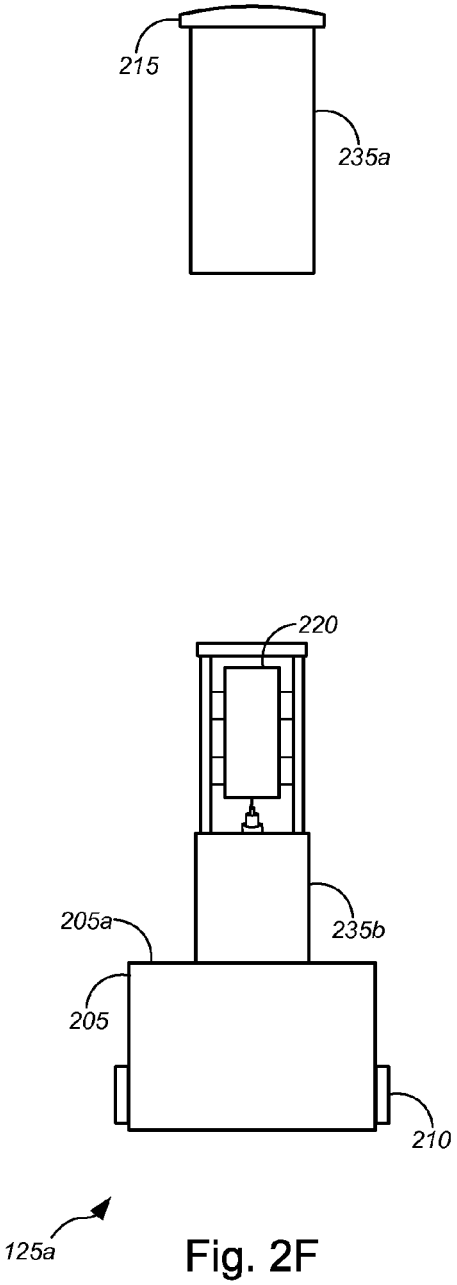
Figure 2G:
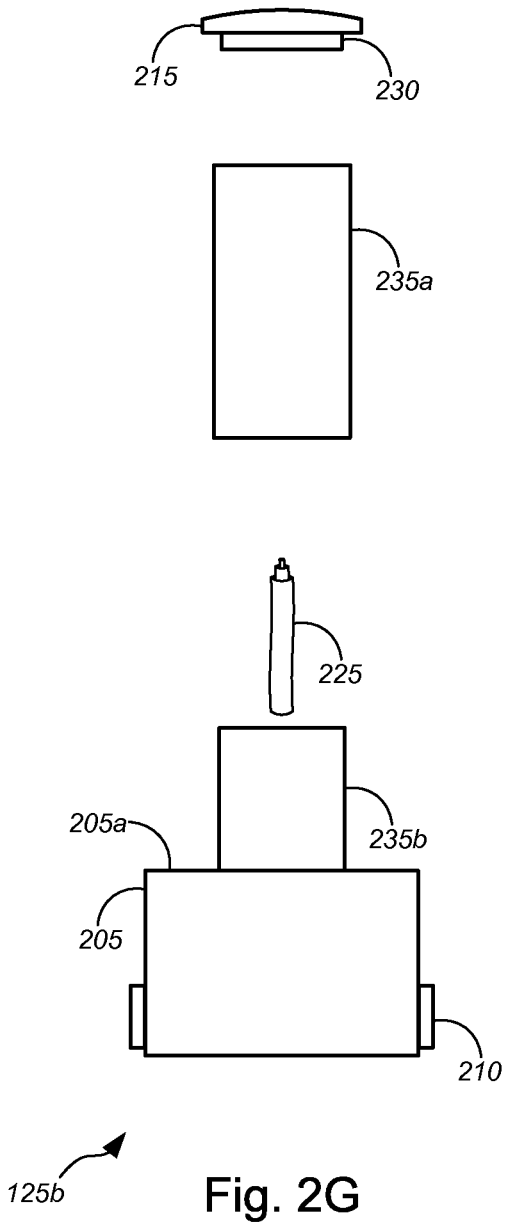
Figure 2H:
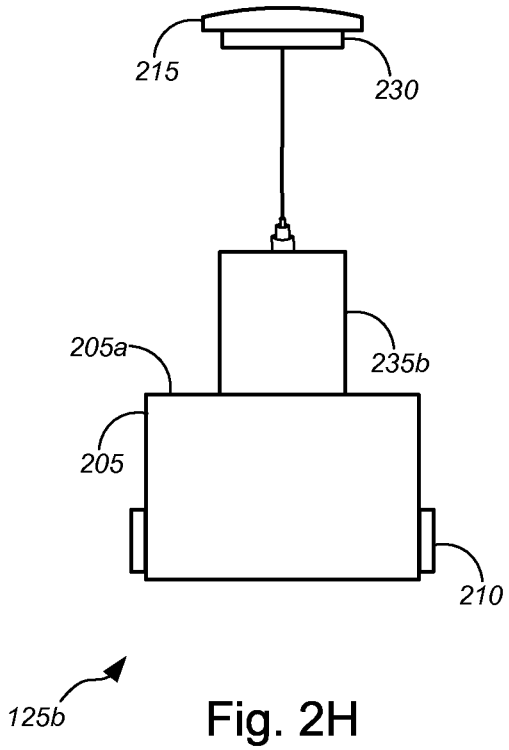
Figure 2I:
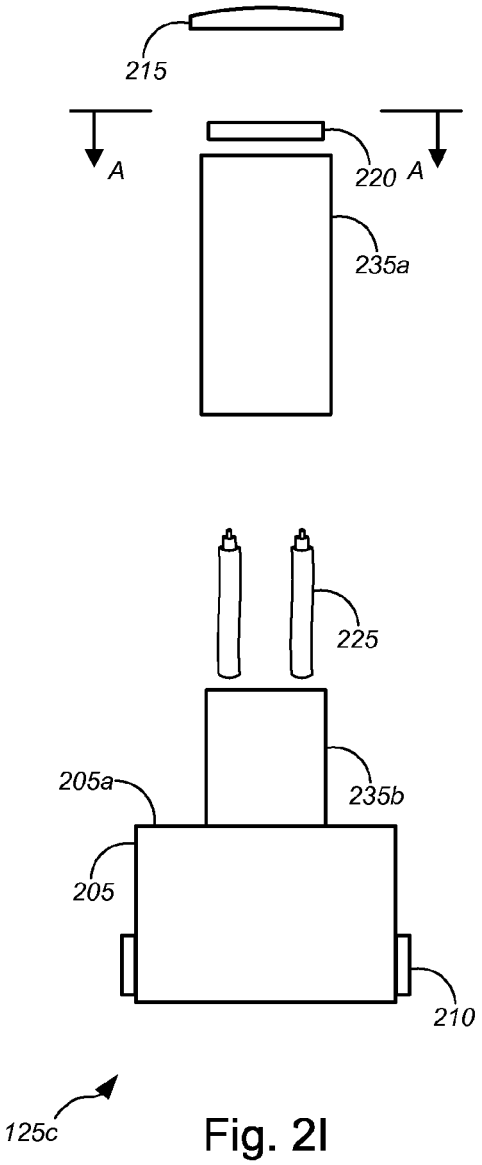
Figure 2J:
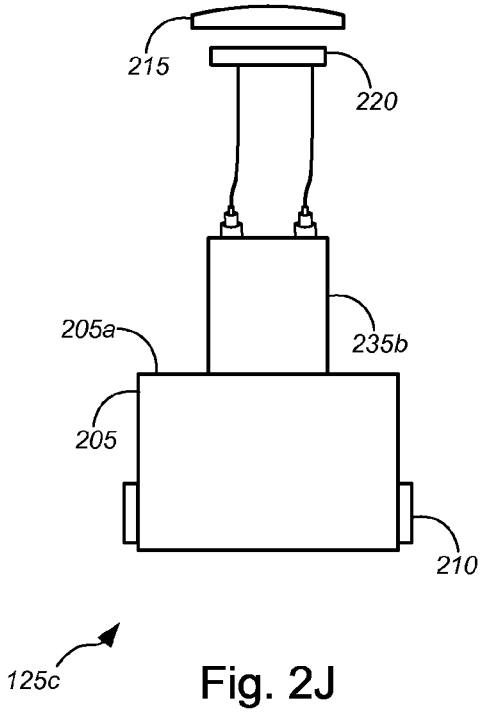
Figure 2K:
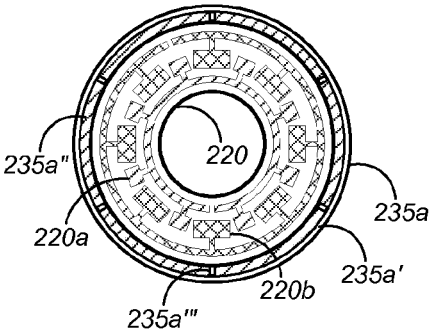
Figure 2M:
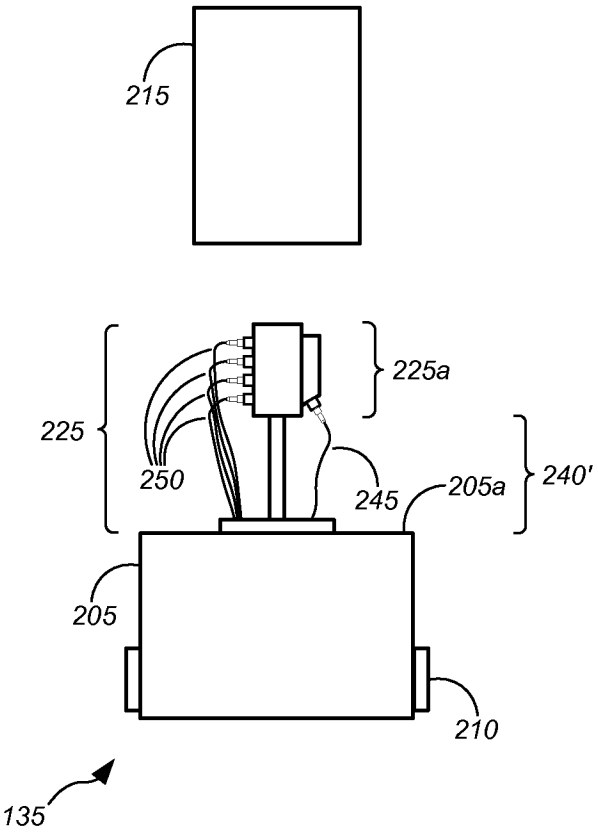
Figure 2L:
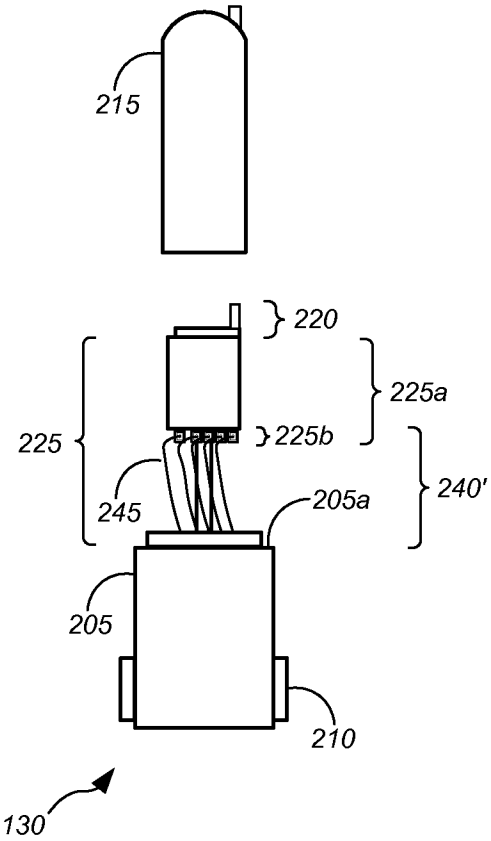

FIGS. 2E-2K show various embodiments of pedestal platform 125, each of which comprises a container 205, at least one conduit port 210, cable distribution system 225, and a pedestal 235. Cable distribution system 225 in FIGS. 2E-2K is illustrated by one or two cables 225, but the various embodiments are not so limited, and cable distribution system 225 can comprise any number of cables, connectors, routing devices, splitters, multiplexers, demultiplexers, converters, transformers, adaptors, splicing components, and/or the like, as appropriate. The pedestal 235 comprises an upper portion 235*a* having a lid 215, and a lower (or base) portion 235*b* that is mounted on or otherwise disposed above a top surface 205*a* of container 205. FIGS. 2E and 2F show an embodiment of pedestal platform 125*a* having a mountable radio 220 ["radio-mounted pedestal"], while FIGS. 2G and 2H show an embodiment of pedestal platform 125*b* having a lid-mounted antenna(s) 230 ["pedestal with in-lid antenna"], and FIGS. 2I-2K show an embodiment of pedestal platform 125*c* having antenna(s) 220 mounted within the upper portion 235*a* of the pedestal ["pedestal with pedestal-mounted antenna"].

In the embodiment of FIGS. 2E and 2F ("radio-mounted pedestal"), pedestal platform 125*a* further comprises a mountable radio 220, and an antenna mounting structure 240 having a support structure 240*a* and an antenna mounting bracket 240*b*. The mountable radio 220 might include, without limitation, one or more of a radio small cell, an access point, a microcell, a picocell, a femtocell, and/or the like. The antenna mounting bracket 240*b* is configured to mount the mountable radio 220. The cable(s) 225 of cable distribution system 225 communicatively couple(s) the mountable radio 220 with one or more of the at least one optical fiber, the at least one conductive signal line (including, but not limited to, copper data lines, copper video lines, copper voice lines, or any suitable (non-optical fiber) data cables, (non-optical fiber) video cables, or (non-optical fiber) voice cables, and/or the like), and/or the like that are provided in the one or more conduits 105. FIG. 2E shows an exploded view, while FIG. 2F shows a partially assembled view without the upper portion 235*a* (and lid 215) covering the pedestal interior components (i.e., without the upper portion 235*a* (and lid 215) being assembled).

In the embodiment of FIGS. 2G and 2H ("pedestal with in-lid antenna"), pedestal platform 125*b* further comprises an antenna 230 that is mounted or otherwise part of lid 215, either disposed completely within the lid 215, disposed below (but mounted to) the lid 215, or disposed partially within the lid 215 and partially extending below the lid 215. The cable(s) 225 of cable distribution system 225 communicatively couple(s) the antenna 230 with one or more of the at least one optical fiber, the at least one conductive signal line (including, but not limited to, copper data lines, copper video lines, copper voice lines, or any suitable non-optical fiber data, video, and/or voice cables, and/or the like), and/or the like that are provided in the one or more conduits 105. FIG. 2G shows an exploded view, while FIG. 2H shows a partially assembled view without the upper portion 235*a* covering the pedestal interior components (i.e., without the upper portion 235*a* being assembled). In FIG. 2H, the lid 215 (and antenna 230) are shown suspended above the base portion 235*b* of the pedestal 125*b* at a height at which the lid 215 (and antenna 230) would be if the upper portion 235*a* were assembled.

In the embodiment of FIGS. 2I-2K ("pedestal with pedestal-mounted antenna"), pedestal platform 125*c* further comprises an antenna 220 that is mounted within upper portion 235*a*. In the embodiment of FIGS. 2I-2K, antenna 220 comprises a plurality of arrays of lateral patch antennas 220*a* and 220*b* (examples of which are described in detail below with respect to FIGS. 3A-3D). FIG. 2I shows an exploded view, while FIG. 2J shows a partially assembled view without the upper portion 235*a* covering the pedestal interior components (i.e., without the upper portion 235*a* being assembled). In FIG. 2J, the lid 215 and antenna 220 are shown suspended above the base portion 235*b* of the pedestal 125*c* at approximate respective heights at which the lid 215 (and antenna 220) would likely be if the upper portion 235*a* were assembled.

FIG. 2K shows a partial top-view of the antenna 220 and upper portion 235*a* (as shown looking in the direction indicated by arrows A-A in FIG. 2I). In FIG. 2K, antenna 220 is shown as an annular antenna having a first array of lateral patch antennas 220*a* and a second array of lateral patch antennas 220*b*, each configured to transmit and receive data, video, and/or voice signals over different frequencies (e.g., radio frequencies, or the like). The cables 225 of cable distribution system 225 communicatively couple each array of lateral patch antennas 220*a*/220*b* with one or more of the at least one optical fiber, the at least one conductive signal line (including, but not limited to, copper data, video, and/or voice lines, or any suitable non-optical fiber data, video, or voice cables, and/or the like), and/or the like that are provided in the one or more conduits 105. Upper portion 235*a* comprises cylindrical wall 235*a*' having a predetermined wall thickness, an annular ring mount 235*a*" mounted to the interior side of the cylindrical wall 235*a*', and a plurality of spacers 235*a*" disposed at predetermined positions about a circumference and on a top portion of the annular ring mount 235*a*". When mounted, the antenna 220 rests on the annular ring mount 235*a*", and is centered (and prevented from lateral shifting) by the plurality of spacers 235*a*" separating the antenna 220 from the interior wall of the upper portion 235*a*. In some cases, the plurality of spacers 235*a*" are positioned equidistant from each other along the circumference of the annular ring mount 235*a*", while in other cases, any appropriate positions along the circumference may be suitable. Ideally, the spacers 235*a*' are chosen or designed to have a length (along a radial direction from a central axis of the annular ring mount 235*a*") and a height that allows the plurality of spacers 235*a*" to snugly space the outer circumference of the antenna 220 and the interior wall 235*a*', while preventing lateral movement of the antenna 220. Although FIG. 2K shows 6 spacers 235*a*", the various embodiments are not so limited, and any number of spacers 235*a*" may be used.

According to some embodiments, the pedestals as described above with respect to FIGS. 2E-2K might include a wide range of pedestals of various shapes and sizes. Some pedestals might be made of materials including, but not limited to, metal, plastic, polymer concrete, and/or the like. Some pedestals might have heights between a few inches (a few centimeters) to about 4 feet (~121.9 cm)—most having heights between about 2 feet (~61.0 cm) and about 3 feet (~91.4 cm)—, as measured between surface 205*a* (of the container 205) and a top portion of the lid 215. For generally cylindrical pedestals, diameters of each of the lid 215, upper portion 235*a*, or lower portion 235*b* might range between about 6 inches (~15.2 cm) to about 12 inches (~30.5 cm). For pedestals having square or rectangular cross-sections, the corners may be rounded, and similar dimensions as the generally cylindrical pedestals may be utilized.

In some cases, each of the lid 215, upper portion 235*a*, or lower portion 235*b* might be nested within an adjacent one; for example, as shown in FIGS. 2E-2K, the lid 215 has a diameter larger than that of the upper portion 235*a*, which has a diameter larger than that of the lower portion 235*b*. Any combination of nesting of the lid 215, upper portion 235*a*, and lower portion 235*b* may be implemented, however. Well-known removable locking/joining mechanisms may be implemented between two adjacent ones of these pedestal components. In some instances, the diameter of two or more adjacent ones of the lid 215, upper portion 235*a*, or lower portion 235*b* might be the same, in which case inner diameter components (including, but not limited to, inner diameter counter-threading, locking mechanisms, posts, or other suitable joining components well-known in the art, and/or the like) may be used to secure the adjacent ones of the lid 215, upper portion 235*a*, or lower portion 235*b* to each other.

FIG. 2L shows an embodiment of NAP platform 130, which comprises a container 205, at least one conduit port 210, cover 215, antenna 220, and cable distribution system 225. In some embodiments, cable distribution system 225 might comprise a signal conversion/splicing system 225*a*, a plurality of ports 225*b*, a support structure 240', and one or more cables 245. The one or more cables 245 communicatively couple with the at least one optical fiber, the at least one conductive signal line (including, but not limited to, copper data lines, copper video lines, copper voice lines, or any suitable (non-optical fiber) data cables, (non-optical fiber) video cables, or (non-optical fiber) voice cables, and/or the like), and/or the like that are provided in the one or more conduits 105. The one or more cables 245 connect with the plurality of ports 225*b*, and data, video, and/or voice signals transmitted through the one or more cables 245 (i.e., to and from the at least one optical fiber, the at least one conductive signal line, and/or the like) and through the plurality of ports 225*b* are processed and/or converted by signal conversion/splicing system 225*a* for wireless transmission and reception by antenna 220. In some cases, cover 215 might comprise components of antenna 220, while in other cases, at least a portion of cover 215 that is adjacent to antenna 220 might be made of a material that allows for radio frequency propagation (and, in some cases, rf gain) therethrough.

In some cases, cover 215 might comprise components of antenna 220, while in other cases, at least a portion of cover 215 that is adjacent to antenna 220 might be made of a material that allows for radio frequency propagation (and, in some cases, rf gain) therethrough. The antenna 220 might wirelessly communicate with one or more utility poles 135 (via one or more transceivers 145), one or more customer premises 155 (via one or more transceivers 145, a wireless NID 160, a wireless ONT 165, an RG 185, and/or the like), and/or one or more mobile user devices 175, or the like.

FIG. 2M shows an embodiment of FDH platform 135, which comprises a container 205, at least one conduit port 210, cover 215, and cable distribution system 225. In some embodiments, cable distribution system 225 might comprise a signal distribution/splicing system 225*a*, a support structure 240', one or more first cables 245, and one or more second cables 250. Each of the one or more first cables 245 communicatively couple with the at least one optical fiber, the at least one conductive signal line (including, but not limited to, copper data lines, copper video lines, copper voice lines, or any suitable (non-optical fiber) data cables, (non-optical fiber) video cables, or (non-optical fiber) voice cables, and/or the like), and/or the like that are provided in the one or more conduits 105. The one or more first cables 245 connect with the signal distribution/splicing system 225*a*, and data, video, and/or voice signals transmitted through the one or more cables 245 (i.e., from the at least one optical fiber, the at least one conductive signal line, and/or the like) are distributed by signal distribution/splicing system 225*a* for transmission over the one or more second cables 250. In some cases, the one or more second cables 250 communicatively couple with data, video, and/or voice lines supported by one or more utility poles 135, or communicatively couple with a NID 160 or an ONT 165 of each of one or more customer premises 155. In a similar manner, data, video, and/or voice signals from the data, video, and/or voice lines supported by one or more utility poles 135, and/or from the NID 160 or the ONT 165 of each of the one or more customer premises 155 may be transmitted through the one or more second cables 250 to be distributed by the signal distribution/splicing system 225*a* back through the one or more first cables 245 and through the at least one optical fiber, the at least one conductive signal line, and/or the like. In some cases, the one or more second cables 250 might be routed back through the at least one conduit port 210 and through the one or more conduits 105 to be distributed under ground surface 110*a* to other ground-based signal distribution devices (including, but not limited to, one or more hand holes 115, one or more flowerpot hand holes 120, one or more pedestal platforms 125, one or more NAP platforms 130, one or more other FDH platforms 135).

In some embodiments, FDH platform 135 might further comprise an antenna 220 (not shown), which might communicatively couple to signal distribution system 225*a*. The antenna 220 might wirelessly communicate with one or more utility poles 135 (via one or more transceivers 145), one or more customer premises 155 (via one or more transceivers 145, a wireless NID 160, a wireless ONT 165, an RG 185, and/or the like), and/or one or more mobile user devices 175, or the like. In such cases, cover 215 might comprise components of antenna 220, while in other cases, at least a portion of cover 215 that is adjacent to antenna 220 might be made of a material that allows for radio frequency propagation (and, in some cases, rf gain) therethrough.

Figure 3A:
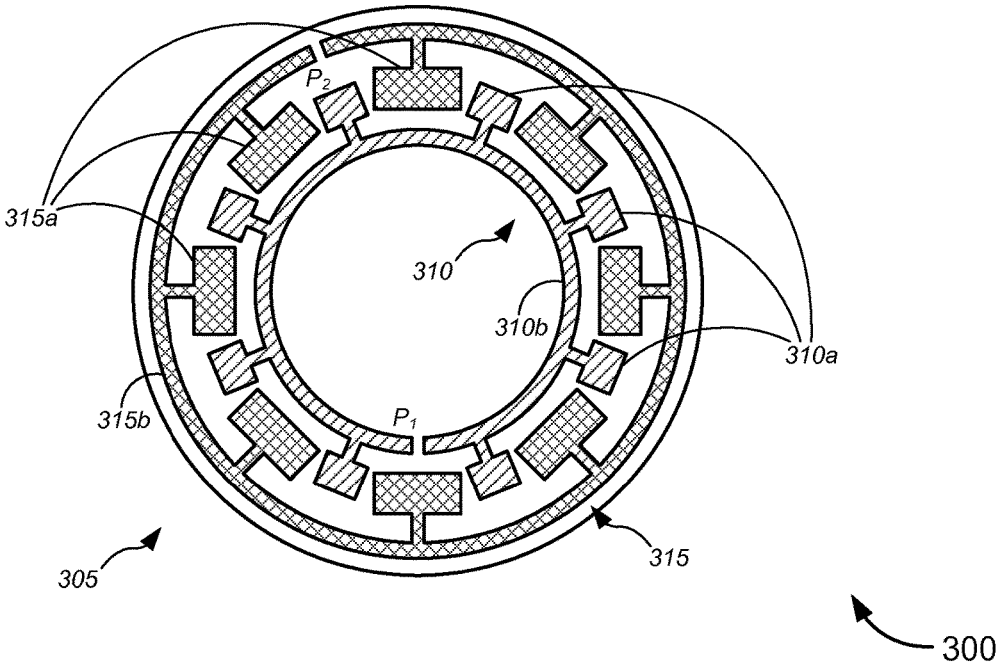
FIGS. 3A-3K are general schematic diagrams illustrating various antennas or antenna designs used in the various ground-based signal distribution devices, in accordance with various embodiments.
Figure 3B:
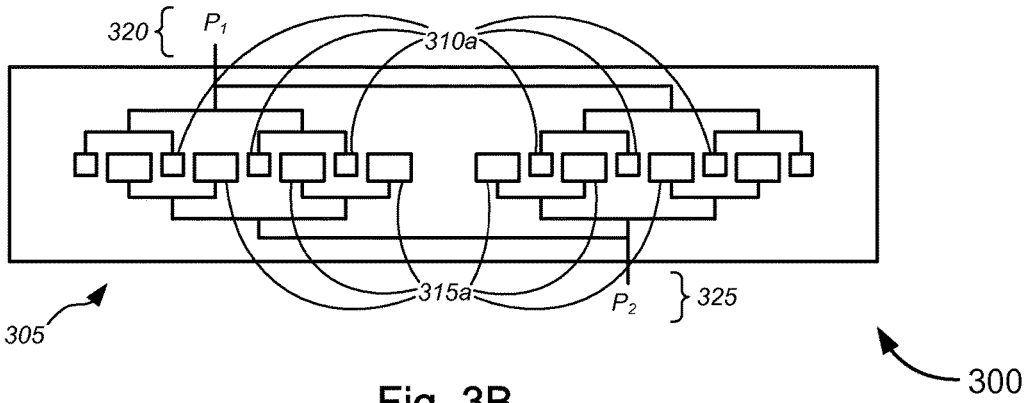
Figure 3C:
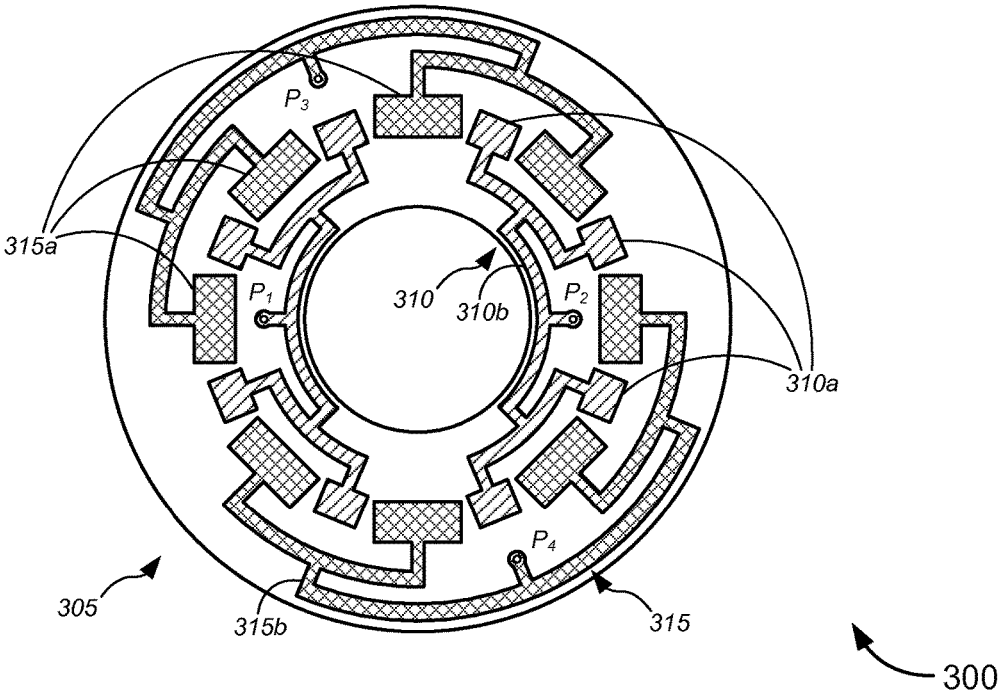
Figure 3D:
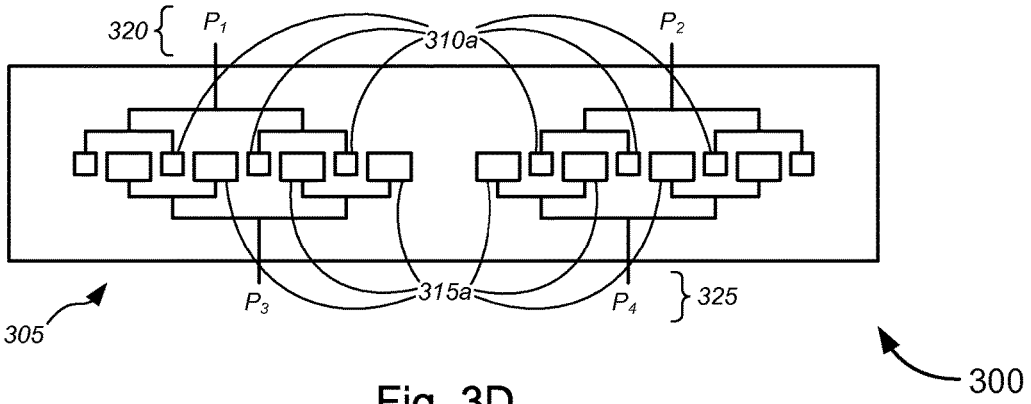
Figure 3E:
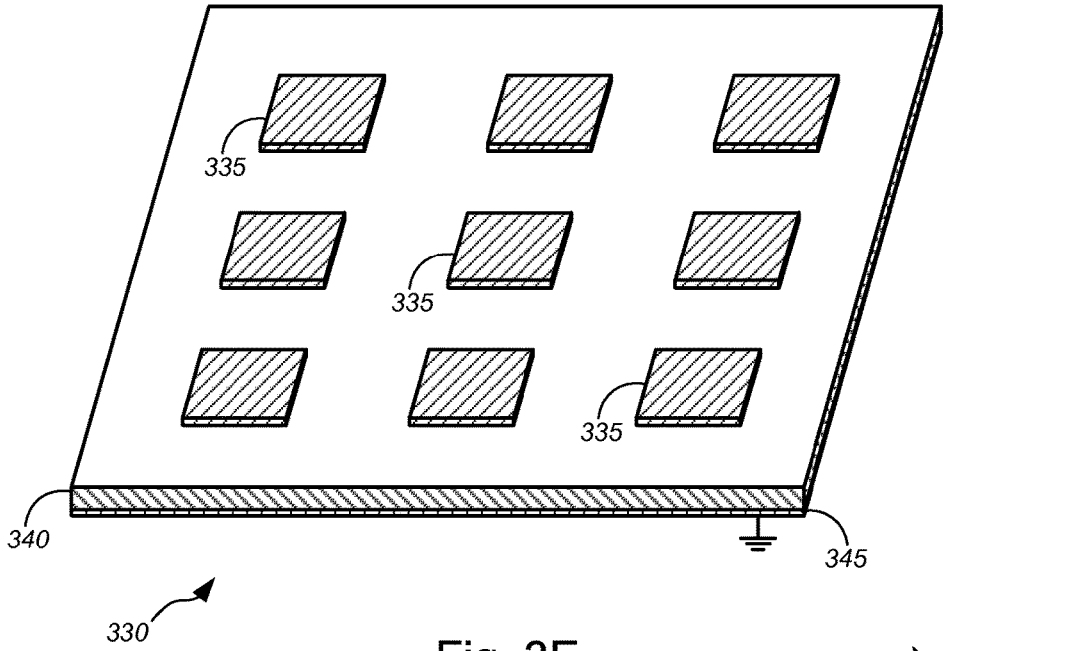
Figure 3F:
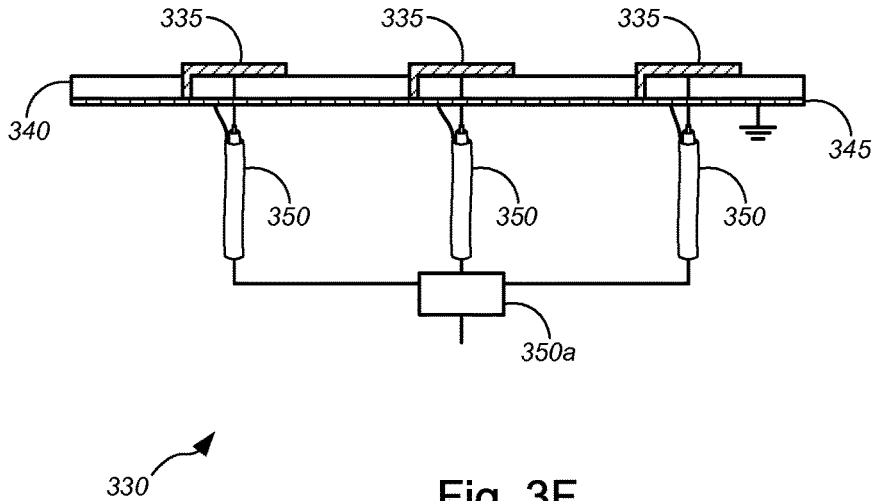
Figure 3G:
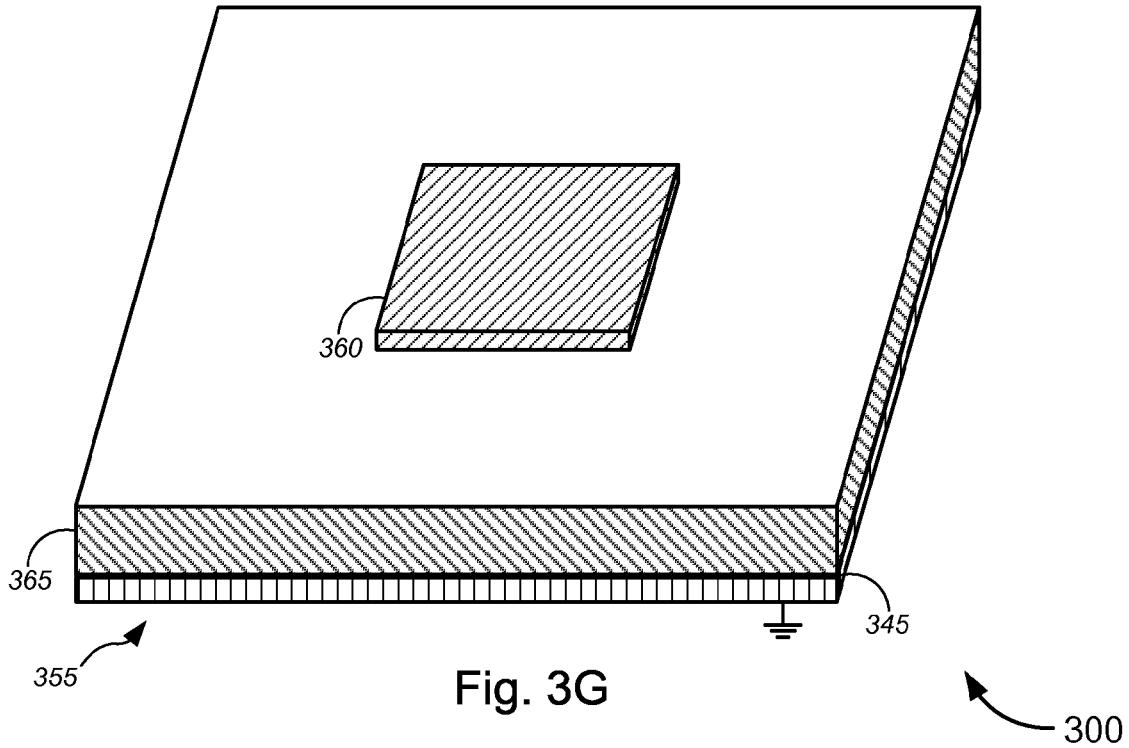
Figure 3H:
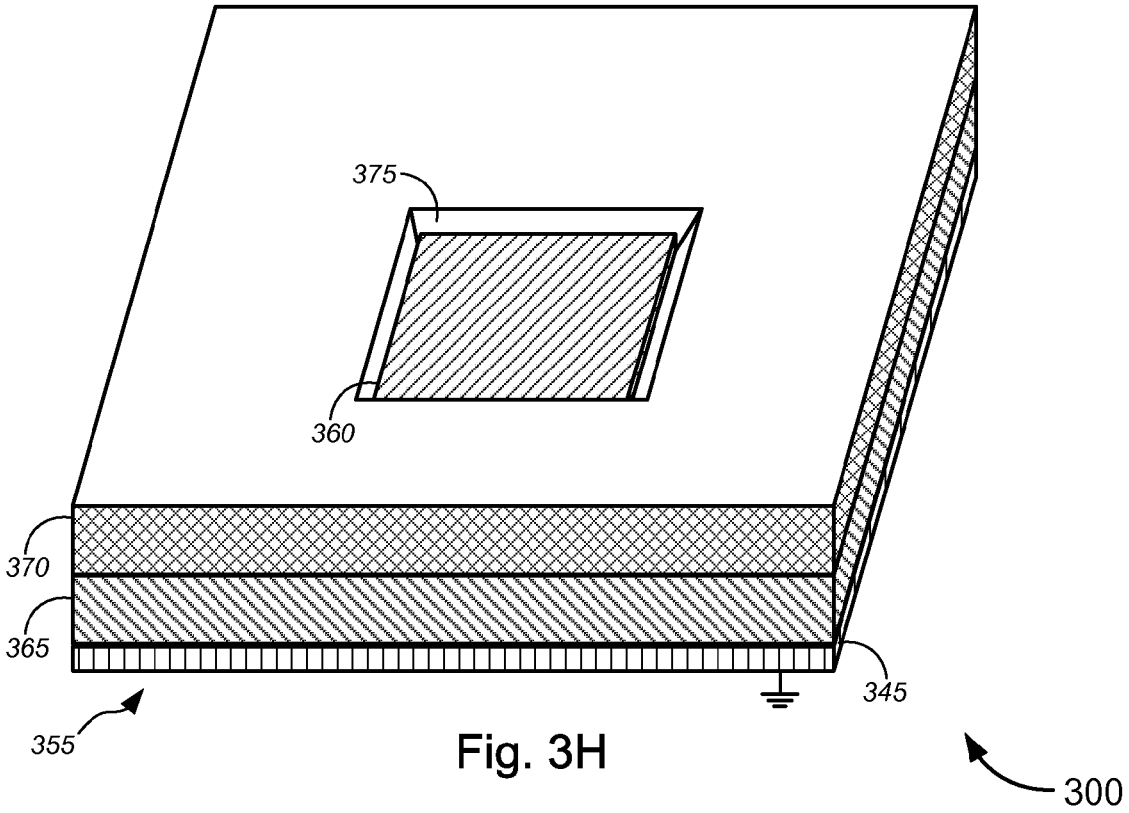
Figure 3I:
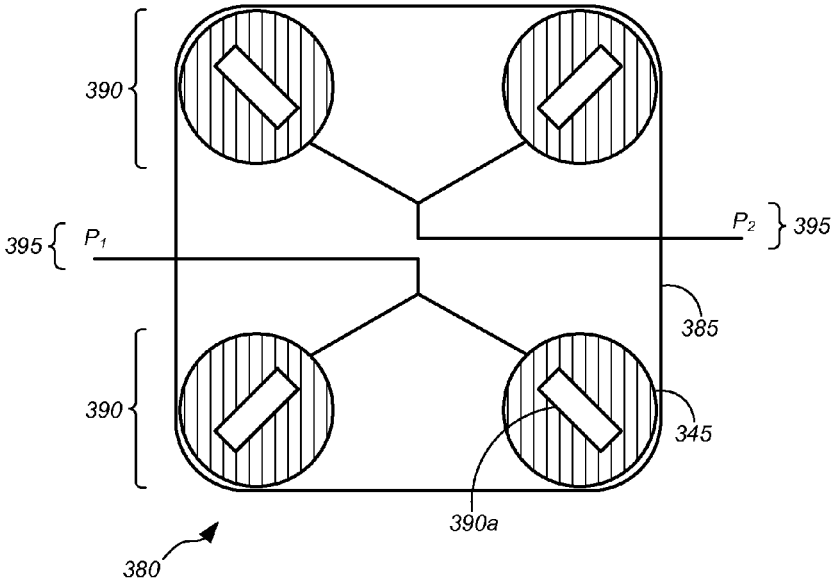
Figure 3J:
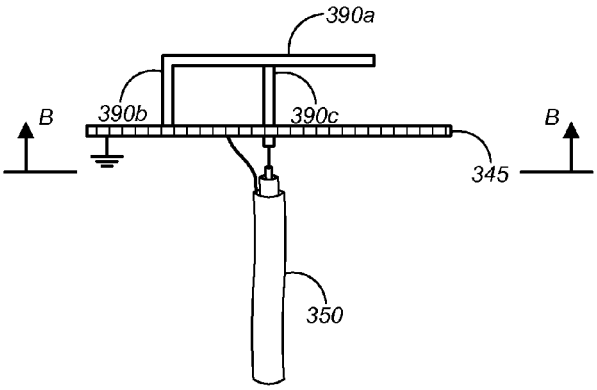
Figure 3K:
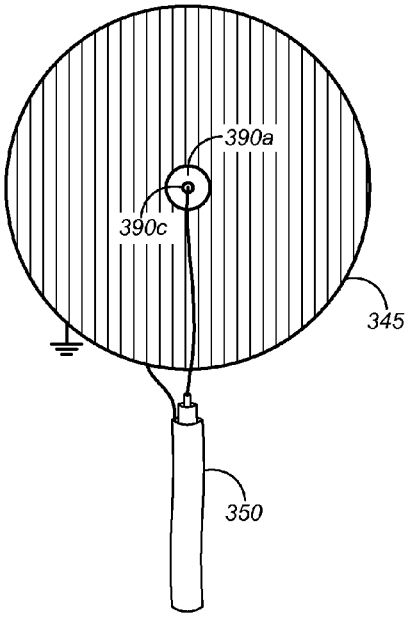

FIGS. 3A-3K (collectively, "FIG. 3") are general schematic diagrams illustrating various antennas or antenna designs 300 used in the various ground-based signal distribution devices, in accordance with various embodiments. In particular, FIGS. 3A-3D show various embodiments of lateral patch antennas (or arrays of lateral patch antennas), while FIGS. 3E-3H show various embodiments of leaky waveguide antennas (also referred to as "planar antennas," "planar waveguide antennas," "leaky planar waveguide antennas," or "2D leaky waveguide antennas," and/or the like). FIGS. 3I-3K show various embodiments of reversed F antennas or planar inverted F antennas ("PIFA").

FIG. 3A shows antenna 305, which includes a plurality of arrays of lateral patch antennas comprising a first array 310 and a second array 315. Antenna 305, in some embodiments, may correspond to antenna 230, which is part of lid 215, either disposed completely within the lid 215, disposed below (but mounted to) the lid 215, or disposed partially within, and partially extending below, the lid 215. In some instances, antenna 305 might correspond to antenna 220, which is disposed below lid 215, either disposed within container 205 (as in the embodiments of FIGS. 2A and 2C), mounted within upper portion 235*a* of pedestal 235 (as in the embodiments of FIGS. 2I-2K), or otherwise disposed under cover 215 (as in the embodiment of FIG. 2L), or the like.

In the non-limiting example of FIG. 3A, the first array of lateral patch antennas 310 might comprise x number of lateral patch antennas 310*a* connected to a common microstrip 310*b* (in this case, x=8). Each lateral patch antenna 310*a* has shape and size designed to transmit and receive rf signals at a frequency of about 5 GHz. At least one end of microstrip 310*b* communicatively couples with a first port $P_1$, which communicatively couples, via cable distribution/splicing system 225 (and via container 205), to one or more of the at least one optical fiber, the at least one conductive signal line (including, but not limited to, copper data lines, copper video lines, copper voice lines, or any suitable (non-optical fiber) data cables, (non-optical fiber) video cables, or (non-optical fiber) voice cables, and/or the like), and/or the like that are provided in the one or more conduits 105.

Also shown in the non-limiting example of FIG. 3A, the second array of lateral patch antennas 315 might likewise comprise y number of lateral patch antennas 315*a* connected to a common microstrip 315*b* (in this case, y=8). In some embodiments x equals y, while in other embodiments, x might differ from y. Each lateral patch antenna 315*a* has shape and size designed to transmit and receive rf signals at a frequency of about 2.4 GHz. At least one end of microstrip 315*b* communicatively couples with a second port $P_2$, which communicatively couples, via cable distribution system 225 (and via container 205), to one or more of the at least one optical fiber, the at least one conductive signal line (including, but not limited to, copper data lines, copper video lines, copper voice lines, or any suitable (non-optical fiber) data cables, (non-optical fiber) video cables, or (non-optical fiber) voice cables, and/or the like), and/or the like that are provided in the one or more conduits 105. In some embodiments, the first port $P_1$ and the second port $P_2$ might communicatively couple to the same one or more of the at least one optical fiber, the at least one conductive signal line, and/or the like, while in other embodiments, the first port $P_1$ and the second port $P_2$ might communicatively couple to different ones or more of the at least one optical fiber, the at least one conductive signal line, and/or the like.

Although 8 lateral patch antennas are shown for each of the first array 310 or the second array 315 (i.e., x=8; y=8), any suitable number of lateral patch antennas may be utilized, so long as: each lateral patch antenna remains capable of transmitting and receiving data, video, and/or voice rf signals at desired frequencies, which include, but are not limited to, 600 MHz, 700 MHz, 2.4 GHz, 5 GHz, 5.8 GHz, and/or the like; each lateral patch antenna has wireless broadband signal transmission and reception characteristics in accordance with one or more of IEEE 802.11a, IEEE 802.11b, IEEE 802.11g, IEEE 802.11n, IEEE 802.11ac, IEEE 802.11ad, and/or IEEE 802.11af protocols; and/or each lateral patch antenna has wireless broadband signal transmission and reception characteristics in accordance with one or more of Universal Mobile Telecommunications System ("UMTS"), Code Division Multiple Access ("CDMA"), Long Term Evolution ("LTE"), Personal Communications Service ("PCS"), Advanced Wireless Services ("AWS"), Emergency Alert System ("EAS"), and/or Broadband Radio Service ("BRS") protocols.

Further, although 2 arrays of patches are shown in FIG. 3A, any number of arrays may be used, including, but not limited to, 1, 2, 3, 4, 6, 8, or more. Each array has a feeding structure, not unlike the microstrip patch feed design shown in FIG. 3A (or in FIG. 3C). In some embodiments, multiple arrays of patches may be connected to a plurality of ports, which can be connected to a multiport Wi-Fi access, using multiple-input and multiple-output ("MIMO") functionality, and in some cases using IEEE 802.11a/b/g/n/ac/ad/af standards.

Patch separation between adjacent patches in each array are typically half-lambda separation or $\lambda/2$ separation (where lambda or $\lambda$ might refer to the wavelength of the rf signal(s)). This allows for some intertwining between patches, particular, intertwining between patches of two or more different arrays of patches. In some embodiments feed lines to the multiple arrays can be separate, or may be combined for dual-/multi-mode devices.

In the example of FIGS. 3A and 3B, the two arrays 310 and 315 each have its own, separate feed lines 310*b* and 315*b*, respectively, leading to separate ports $P_1$ and $P_2$, respectively. FIG. 3B shows a schematic diagram of an example of feed line configuration for the two arrays 310 and 315. In particular, in FIG. 3B, each of the lateral patches 310*a* of the first array 310 share a single feed line 310*b* that lead to port $P_1$ (or port 320). Likewise, each of the lateral patches 315*a* share a single feed line 315*b* that lead to port $P_2$ (or port 325). Feed lines 310*b* and 315*b* are separate from each other, as ports 320 and 325 are separate from each other.

FIGS. 3C and 3D are similar to FIGS. 3A and 3B, respectively, except that the first array 310 or the second array 315 are each configured as two separate arrays (totaling four separate arrays in the embodiment of FIG. 3C). In particular, in FIG. 3C, the first array 310 comprises a third array and a fourth array. The third array might comprise x' number of lateral patch antennas 310*a* connected to a common microstrip 310*b* (in this case, x'=4), while the fourth array might comprise x" number of lateral patch antennas 310*a* connected to a common microstrip 310*b* (in this case, x"=4). Although the third array and fourth array are shown to have the same number of lateral patch antennas 310*a* (i.e., x'=x"), the various embodiments are not so limited and each array can have different numbers of lateral patch antennas 310*a* (i.e., can be x'≠x"). Similarly, although x' and x" are shown to equal 4 in the example of FIG. 3C, any suitable number of lateral patch antennas may be used, as discussed above with respect to the number of lateral patch antennas for each array.

Similarly, the second array 315 comprises a fifth array and a sixth array. The fifth array might comprise y' number of lateral patch antennas 315*a* connected to a common microstrip 315*b* (in this case, y'=4), while the sixth array might comprise y" number of lateral patch antennas 315*a* connected to a common microstrip 315*b* (in this case, y"=4). Although the fifth array and sixth array are shown to have the same number of lateral patch antennas 315*a* (i.e., y'=y"), the various embodiments are not so limited and each array can have different numbers of lateral patch antennas 315*a* (i.e., can be y'≠y"). Similarly, although y' and y" are shown to equal 4 in the example of FIG. 3C, any suitable number of lateral patch antennas may be used, as discussed above with respect to the number of lateral patch antennas for each array.

Further, although only two sub-arrays are shown for each of the first array 310 and for the second array 315, any suitable number of sub-arrays may be utilized for each of the first array 310 and for the second array 315, and the number of sub-arrays need not be the same for the two arrays. In the case that antenna 305 comprises three or more arrays, any number of sub-arrays for each of the three or more arrays may be utilized, and the number of sub-arrays may be different for each of the three or more arrays.

Turning back to FIGS. 3C and 3D, each of the third, fourth, fifth, and sixth arrays are separately fed by separate microstrips 310*b*/315*b*, each communicatively coupled to separate ports, $P_1$-$P_4$, respectively. FIG. 3D shows a schematic diagram of an example of feed line configuration for each of the two sub-arrays for each of the two arrays 310 and 315. In particular, in FIG. 3D, each of the lateral patches 310*a* of the third array share a single feed line 310*b* that lead to port $P_1$, while each of the lateral patches 310*a* of the fourth array share a single feed line 310*b* that lead to port $P_2$. Ports $P_1$ and $P_2$ (i.e., ports 320) may subsequently be coupled together to communicatively couple, via cable distribution system 225 (and via container 205), to one or more of the at least one optical fiber, the at least one conductive signal line (including, but not limited to, copper data lines, copper video lines, copper voice lines, or any suitable (non-optical fiber) data cables, (non-optical fiber) video cables, or (non-optical fiber) voice cables, and/or the like), and/or the like that are provided in the one or more conduits 105. Alternatively, ports $P_1$ and $P_2$ (i.e., ports 320) may each separately communicatively couple, via cable distribution system 225 (and via container 205), to one or more of the at least one optical fiber, the at least one conductive signal line, and/or the like that are provided in the one or more conduits 105.

Likewise, each of the lateral patches 315*a* of the fifth array share a single feed line 315*b* that lead to port $P_3$ (or port 325), while each of the lateral patches 315*a* of the sixth array share a single feed line 315*b* that lead to port $P_4$. Ports $P_3$ and $P_4$ (i.e., ports 325) may jointly or separately be communicatively coupled, via cable distribution system 225 (and via container 205), to one or more of the at least one optical fiber, the at least one conductive signal line (including, but not limited to, copper data lines, copper video lines, copper voice lines, or any suitable (non-optical fiber) data cables, (non-optical fiber) video cables, or (non-optical fiber) voice cables, and/or the like), and/or the like that are provided in the one or more conduits 105. Feed lines 310*b* and 315*b* are separate from each other, as ports 320 and 325 are separate from each other.

The embodiments of FIGS. 3C and 3D are otherwise similar, or identical to, the embodiments of FIGS. 3A and 3B, respectively. As such, the descriptions of the embodiments of FIGS. 3A and 3B similar apply to the embodiments of FIGS. 3C and 3D, respectively.

FIGS. 3E-3H show embodiments of leaky planar waveguide antennas 330 and 355. In FIG. 3E, antenna 330 comprises a plurality of patch antennas 335 disposed or fabricated on a thin dielectric substrate 340. Antenna 330 further comprises a ground plane 345. In some embodiments, each of the plurality of patch antennas 335 might comprise an L-patch antenna 335 (as shown in FIG. 3F), with a planar portion substantially parallel with the ground plane 345 and a grounding strip that extends through the dielectric substrate 340 to make electrical contact with the ground plane 345 (in some cases, the grounding strip is perpendicular with respect to each of the planar portion and the ground plane 345). According to some embodiments, each of the plurality of patch antennas 335 might comprise a planar patch antenna 335 (i.e., without a grounding strip connecting the planar portion with the ground plane 345). Dielectric substrate 340 is preferably made of any dielectric material, and is configured to have a dielectric constant (or relative permittivity) $\in_r$ that ranges between about 3 and 10.

FIG. 3F shows a plurality of L-patch antennas 335 each being electrically coupled to one of a plurality of cables 350. Although a plurality of cables 350 is shown, a single cable 350 with multiple leads connecting each of the plurality of L-patch antennas 335 may be used. The grounding lead for each of the plurality of cables 350 may be electrically coupled to the ground plane 345. In the case that a plurality of cables 350 are used, the signals received by each antenna 335 may be separately received and relayed to one of the at least one optical fiber, the at least one conductive signal line, and/or the like that are provided in the one or more conduits 105, or the received signals may be combined and/or processed using a combiner 350*a* (which might include, without limitation, a signal processor, a multiplexer, signal combiner, and/or the like). For signal transmission, signals from the at least one conductive signal line, and/or the like that are provided in the one or more conduits 105 may be separately relayed to each of the antennas 335 via individual cables 350, or the signals each of the at least one conductive signal line, and/or the like can be divided using a divider 350*a* (which might include, but is not limited to, a signal processor, a demultiplexer, a signal divider, and/or the like) prior to individual transmission by each of the antennas 335.

FIGS. 3G and 3H illustrate antennas without and with additional elements (including, without limitation, additional directing elements, a second dielectric layer, optional elements atop the second dielectric layer, and/or the like), respectively, that may be added to the planar structure to further direct antenna radiation patterns to predetermined angles (e.g., lower or higher elevation angles, or the like). In FIG. 3G, antenna 355 might comprise a patch antenna 360, which might include a planar patch antenna, an L-patch antenna, or the like. Antenna 355 might further comprise a dielectric substrate 365 on which patch antenna 360 might be disposed. Antenna 355 might further comprise a ground plane 345. Dielectric substrate 365 and ground plane 345, in some embodiments, might be similar, or identical to, dielectric substrate 340 and ground plane 345, respectively, described above with respect to FIGS. 3E and 3F, and thus the corresponding descriptions of dielectric substrate 340 and ground plane 345 above apply similarly to dielectric substrate 365 and ground plane 345. In some instances, the dimensions of each of dielectric substrate 365 and ground plane 345 of FIG. 3G-3H might differ from the dimensions of each of dielectric substrate 340 and ground plane 345 of FIGS. 3E-3F, respectively. In still other cases, dielectric substrate 365 and dielectric substrate 340 might differ in terms of their corresponding dielectric material having different dielectric constant (or relative permittivity) $\in_r$ (although in some embodiments, the dielectric constant or relative permittivity $\in_r$ of each of dielectric substrate 365 ($\in_{r1}$) and dielectric substrate 340 ($\in_r$) might range between about 3 and 10).

In FIG. 3H, antenna 355 might further comprise with additional elements 370, which might include, but are not limited to, additional directing elements, a second dielectric layer, optional elements atop the second dielectric layer, and/or the like. The additional elements 370 serve to further direct antenna radiation patterns to predetermined angles (e.g., lower or higher elevation angles, or the like). FIG. 4 illustrates radiation patterns for some exemplary planar antennas. The additional elements 370 might comprise opening 375, which might be configured to have either a perpendicular inner wall or a tapered inner wall, in order to facilitate focusing of the radiation patterns. In some embodiments the dielectric constant or relative permittivity $\in_{r2}$ of additional elements 370 is chosen to be less than the dielectric constant or relative permittivity $\in_{r1}$ of dielectric substrate 365. With a lower dielectric constant or relative permittivity compared with that of the dielectric substrate 365 below it, the additional elements 370 might focus the radiation patterns or signals closer to the horizon.

FIGS. 3G and 3H show an antenna 355 including a single patch antenna 355, which could include a planar patch antenna, an L-patch antenna, or the like. In some instances, the single antenna 355 might be part of a larger array of antennas, while, in other cases, the single antenna 355 might be a stand-alone antenna. For the purposes of illustration, only a single antenna is shown in FIGS. 3G and 3H to simplify the description thereof.

FIGS. 3I-3K show embodiments of reversed F antennas or planar inverted F antennas ("PIFA"), which are typically used for wide, yet directed antenna radiation patterns. As shown in FIG. 3I, a plurality of PIFA elements 390 can be placed around the top (i.e., an annulus or crown) of a pedestal or other signal distribution device, thus achieving a good omnidirectional coverage around the signal distribution device, focused at low elevation (i.e., horizon bore sight). The signal distribution device might include, but is not limited to, one or more hand holes 115, one or more flowerpot hand holes 120, one or more pedestal platforms 125, one or more network access point ("NAP") platforms 130, one or more fiber distribution hub ("FDH") platforms 135, and/or the like. According to some embodiments, some PIFA elements can be placed inside pedestal plastic structures.

In the embodiment shown in FIG. 3I, in particular, antenna 380 might comprise a plurality of PIFA elements 390 disposed on base portion 385. In this embodiment, 4 PIFA elements 390 are shown disposed at different corners of a square base portion 385, which might be disposed on/in a top portion (e.g., upper portion 235*a*), annulus (e.g., annular ring mount 235*a*"), crown, or lid (e.g., lid 215) of a pedestal (e.g., pedestal 125), though the various embodiments may include any suitable number of PIFA elements 390. For example, 2 or 4 more PIFA elements might be placed on each side of the base portion 385.

As shown in FIGS. 3I-3K, each PIFA element 390 might comprise an antenna portion 390*a*, a shorting pin 390*b*, a feed point 390*c*, and a ground plane 345. In some embodiments, the antenna portion 390*a* might be a rectangular segment having length, width, and area dimensions configured to transmit and receive rf signals having particular frequencies. The shorting pin 390*b* might be one of a rectangular segment having a width that is the same as the width of the antenna portion 390*a*, a rectangular segment having a width smaller than the width of the antenna portion 390*a*, or a wire connection, and the like. The feed point 390*c* might, in some instances, include one of a pin structure, a block structure, a wire connection, and/or the like. The feed point 390*c* might communicatively couple to cable 350, which might communicatively couple to one of the at least one optical fiber, the at least one conductive signal line, and/or the like that are provided in the one or more conduits 105. Like in the embodiment of FIG. 3F, the grounding lead for each cable 350 may be electrically coupled to the ground plane 345. In some cases, the ground plane 345 might be circular (as shown, e.g., in FIGS. 3I and 3K), rectangular, square, or some other suitable shape.

In some embodiments, several PIFA elements 390 may be combined in a similar manner as described above with respect to the combiner/divider 350*a* (in FIG. 3F). Alternatively, some or all of the PIFA elements 390 may be left independent for a MIMO antenna array (as also described above). According to some embodiments, some PIFA elements might further comprise dielectric substrates, not unlike the dielectric substrates described above with respect to FIGS. 3E-3H.

Although the above embodiments in FIGS. 3A-3K refer to customized transceiver or radio elements, some embodiments might utilize commercial grade radio equipment with built-in smart antennas. Many Wi-Fi radio manufacturers are improving antennas to include arrays that are well-suited for adapting to difficult propagation environments, such as ones created by a low pedestal or hand hole with obstructing buildings around. Placing such commercial devices with good smart antenna capabilities in the top (dome) of the pedestal (or in the lid of hand holes) may achieve sufficient results in limited reach scenarios.

Further, although the various antenna types described above are described as stand-alone or independent antenna options, the various embodiments are not so limited, and the various antenna types may be combined into a single or group of sets of antennas. For example, the planar waveguide antennas of FIGS. 3E-3H may be combined with lateral microstrip patch arrays of FIGS. 3A-3D and/or with the lateral PIFA arrays of FIGS. 3I-3K, due to their different (and sometimes complementary) main orientations. Lateral arrays can, for instance, provide good access to nearby homes, whereas top leaky waveguide antennas can add access to a higher location (including, but not limited to, multi-story multi-dwelling units, or the like), or can provide backhaul to a nearby utility pole or structure with another access point, and/or the like.

With reference to FIG. 4, a general schematic diagram is provided illustrating an example of radiation patterns 405 for a planar antenna or a planar antenna array(s), as used in a system for implementing wireless and/or wired transmission and reception of signals through ground-based signal distribution devices, in accordance with various embodiments. The '034 Application, which has already been incorporated herein by reference in its entirety, describes in further detail embodiments for implementing fiber lines (which may include conductive signal lines and power lines as well) within the apical conduit system and through ground-based signal distribution devices to service customer premises, and the wireless antennas and wireless access points described herein may be implemented within such ground-based signal distribution devices and apical conduit systems. The '691 and 012500US Applications, which have also been incorporated herein by reference in their entirety, describe in further detail an apical conduit system that utilizes wireless access points within ground-based signal distribution devices, and the wireless antennas and wireless access points described herein may be implemented within such ground-based signal distribution devices and apical conduit systems.

In FIG. 4, a planar antenna or a planar antenna array(s) might be configured to provide predetermined omnidirectional azimuthal radio frequency ("rf") propagation. Herein, "omnidirectional rf propagation" might refer to rf propagation that extends 360° radially outwardly from a vertical axis (shown in FIG. 4 as the z-axis) and at least partially along a horizontal axis (shown in FIG. 4 as the x-axis), while "azimuthal rf propagation" might refer to rf propagation that is tilted with respect to the vertical axis (shown in FIG. 4 as the z-axis) by a predetermined angle (shown in FIG. 4 as angle θ, where angles θ and θ' are typically (or defaulted as being) equal). Hence, "omnidirectional rf propagation" (in the context of the example of FIG. 4) might refer to rf propagation that extends 360° radially outwardly from the vertical axis (i.e., z-axis) and at least partially along the horizontal axis (i.e., x-axis), while being tilted with respect to the vertical axis (i.e., z-axis) by the predetermined angle (i.e., angle θ). In some embodiments, the predetermined angle (i.e., angle θ) might include any angle within a range of about 20-60°, and preferably within a range of about 30-45°. Other radiation patterns within the pattern 405 that have lower amplitude may also be used for signal transmission and reception, but are relied upon to a lesser degree because of their lower amplitude gains (as indicated by their smaller-sized profiles).

In some cases, the planar antenna or planar antenna array(s) might be provided within or under a lid of a pedestal platform (as shown in FIG. 4), or within or under a lid of any of a hand hole, a flowerpot hand hole, a NAP platform, a FDH platform, and/or the like. In such cases, the lid might be made of a material that provides predetermined omnidirectional azimuthal rf gain. The height of the pedestal platform, the NAP platform, the FDH platform, and/or the like may be configured to complement or supplement the radiation patterns 405 in order for radiation fields to align with predetermined signal paths/directions (as indicated by arrows 410 shown in FIG. 4) to wirelessly communicate with (or to otherwise transmit and receive signals to and from) wireless transceivers 145 mounted on utility poles 135 or on exterior portions of customer premises 155.

In some cases, additional elements (such as those as shown and described above with respect to FIG. 3H) may be added to the planar structure to further direct antenna radiation patterns to predetermined angles (e.g., lower and/or higher elevation angles, or the like). As described with respect to FIG. 3H, this might be achieved by adding additional directing elements, adding a second dielectric layer, adding optional elements atop the second dielectric layer, and/or the like.

In some embodiments, the planar antenna or planar antenna array(s) (or other wireless antenna(s)) might be provided so as to be within line of sight of wireless transceivers 145 mounted on utility poles 135 or on exterior portions of customer premises 155. In particular, wireless antennas based on 60 GHz communications links of IEEE 802.11ad are typically based on, and optimally operate when using, line of sight wireless communications. Wireless antennas based on 2.4 or 5 GHz communications links need not be within line of sight of the wireless transceivers 145, but can, in some cases, benefit (e.g., in terms of signal strength, range, and/or fidelity) from such line of sight arrangement/configuration.

In some aspects, if the locations are known for each of one or more customer premises 155, one or more utility poles 135, or both that are intended to be served by a particular ground-based signal distribution device (which may, merely by way of example, be a pedestal platform 125, as shown in FIG. 4), and the location and height of the pedestal platform 125 is known relative to each of the one or more customer premises 155, one or more utility poles 135, or both, antenna(s), planar antenna(s), or arrays of planar antenna(s) may be designed—including using additional directing elements, adding a second dielectric layer, adding optional elements atop the second dielectric layer, modifying propagation characteristics of the pedestal lid, and/or the like—in order to achieve the required or desired radiation patterns for communicating with each of the one or more customer premises 155, one or more utility poles 135, or both. In some embodiments, especially where the distances and heights of the transceivers 145 differ for the different ones of the one or more customer premises 155, one or more utility poles 135, or both, the additional directing elements, the second dielectric layer, the optional elements atop the second dielectric layer, the modified pedestal lid, and/or the like might be different along the circumference (or different for particular ranges of angles along the 360° range about the vertical axis) to achieve radiation patterns that include signal paths 410 that are aimed or focused toward each transceiver 145. For example, with reference to FIG. 4, angle θ might be set to about 30° to focus a signal path 410 toward the transceiver 145 mounted on the utility pole 135, while angle θ' might be set to about 40° to focus a signal path 410 toward the transceiver 145 mounted on the customer premises 155, by selectively modifying the propagation characteristics of the antenna(s) and/or of the lid, according to the one or more techniques described above. In some cases, the height of the particular ground-based signal distribution devices may be raised or lowered (or both along different radial directions), to facilitate proper focusing of the signal paths 410.

FIGS. 5A-5D (collectively, "FIG. 5") are flow diagrams illustrating various methods 500 for implementing wireless and/or wired transmission and reception of signals through ground-based signal distribution devices, in accordance with various embodiments.

Figure 5A:
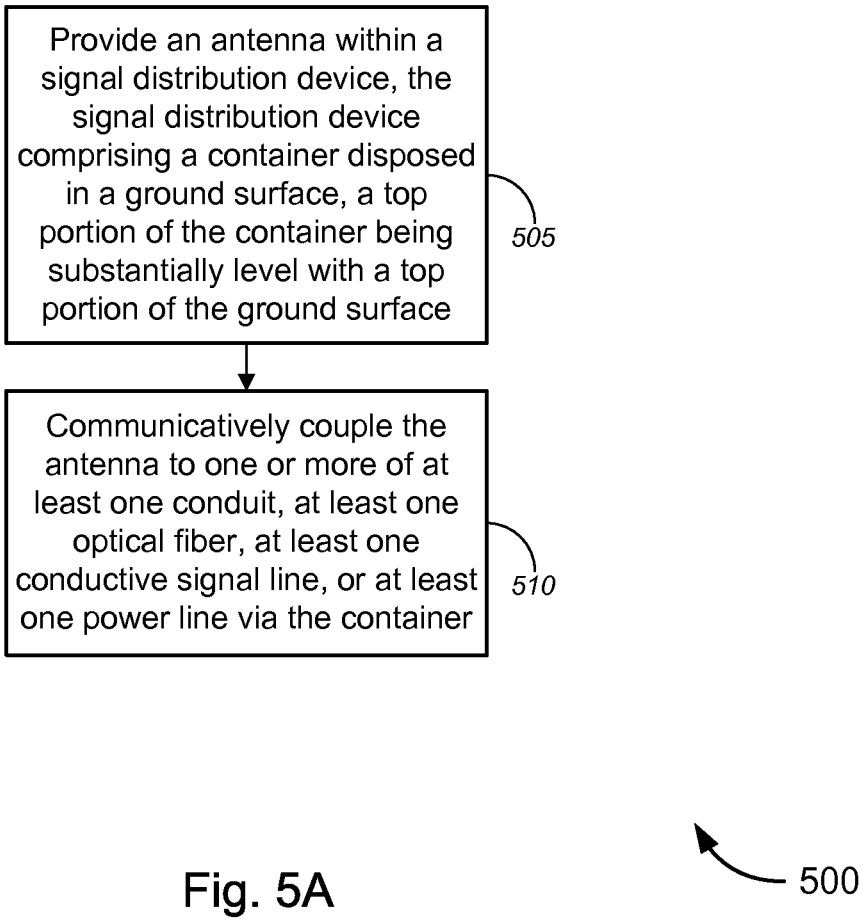

In FIG. 5A, method 500 might comprise providing an antenna within a signal distribution device, the signal distribution device comprising a container disposed in a ground surface, the top portion of the container being substantially level with a top portion of the ground surface (block 505). The antenna might include, but is not limited to, one or more of the antennas shown in, and described with respect to, FIG. 3 above. The signal distribution device might include, without limitation, a hand hole 115, a flowerpot hand hole 120, a pedestal platform 125, a NAP platform 130, a FDH platform 135, and/or the like, as shown in, and as described with respect to, FIGS. 1-4 above. As shown in the embodiments of FIGS. 1 and 4, the top portion of the container 205*a* is substantially level with a top portion of the ground surface 110*a*.

At block 510, method 500 might comprise communicatively coupling the antenna to one or more of at least one conduit, at least one optical fiber, at least one conductive signal line, or at least one power line via the container. The at least one conductive signal line might include, without limitation, copper data lines, copper video lines, copper voice lines, or any suitable (non-optical fiber) data cables, (non-optical fiber) video cables, or (non-optical fiber) voice cables, and/or the like.

Figure 5D:
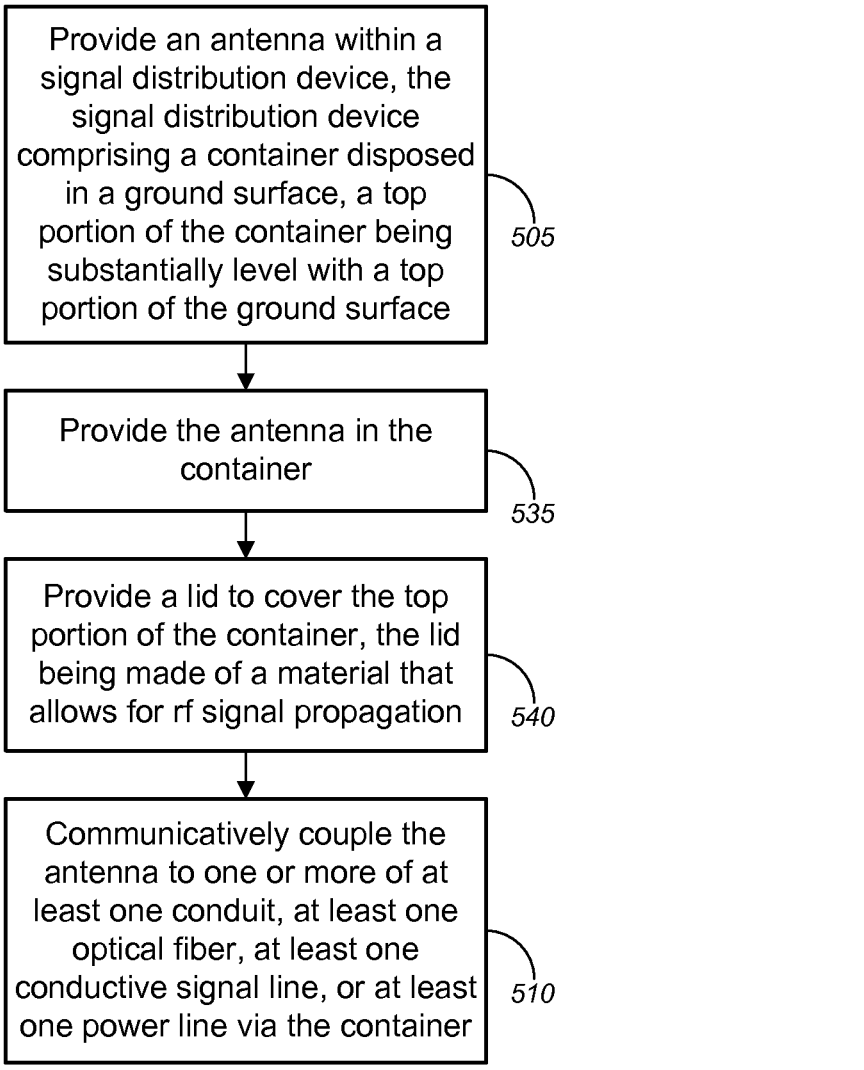

In FIGS. 5B-5D, alternative or additional processes further define providing the antenna within the signal distribution device at block 505. In particular, in FIG. 5B, providing the antenna within the signal distribution device might comprise providing a pedestal disposed above the top portion of the container (block 515) and providing the antenna in the pedestal (block 520). This might include establishing or installing a pedestal platform 125, a NAP platform 130, a FDH platform, or the like, as shown and described above with respect to, e.g., FIGS. 1, 2E-2M, 3, and 4.

In FIG. 5C, providing the antenna within the signal distribution device might comprise providing an antenna lid covering the top portion of the container (block 525) and providing the antenna in the antenna lid (block 530). This might include establishing or installing a hand hole 115, a flowerpot hand hole 120, or the like, as shown and described above with respect to, e.g., FIGS. 1, 2B, 2D, 3, and 4.

In FIG. 5D, providing the antenna within the signal distribution device might comprise providing the antenna in the container (block 535) and providing a lid covering the top portion of the container, the lid being made of a material that allows for radio frequency ("rf") signal propagation (block 540). This might include establishing or installing a hand hole 115, a flowerpot hand hole 120, or the like, as shown and described above with respect to, e.g., FIGS. 1, 2A, 2C, 3, and 4.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture, but instead can be implemented on any suitable hardware, firmware, and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A method, comprising:

providing an antenna within a signal distribution device, the signal distribution device comprising a container disposed in a ground surface, a top portion of the container being substantially level with a top portion of the ground surface;

communicatively coupling the antenna to one or more of at least one conduit, at least one optical fiber, at least one conductive signal line, or at least one power line via the container;

providing a pedestal disposed above the top portion of the container; and providing the antenna in the pedestal.

2. The method of claim 1, wherein the antenna transmits and receives wireless broadband signals according to a set of protocols selected from a group consisting of IEEE 802.11a, IEEE 802.11b, IEEE 802.11g, IEEE 802.11n, IEEE 802.11ac, IEEE 802.11ad, and IEEE 802.11af.

3. The method of claim 1, wherein the antenna transmits and receives wireless broadband signals according to a set of protocols selected from a group consisting of Universal Mobile Telecommunications System ("UMTS"), Code Division Multiple Access ("CDMA"), Long Term Evolution ("LTE"), Personal Communications Service ("PCS"), Advanced Wireless Services ("AWS"), Emergency Alert System ("EAS"), and Broadband Radio Service ("BRS").

4. An apparatus, comprising:

an antenna disposed within a signal distribution device, the signal distribution device comprising a container disposed in a ground surface, a top portion of the container being substantially level with a top portion of the ground surface, and the antenna communicatively coupled to one or more of at least one conduit, at least one optical fiber, at least one conductive signal line, or at least one power line via the container; and a pedestal disposed above the top portion of the container, wherein the antenna is disposed in the pedestal.

5. The apparatus of claim 4, wherein the pedestal comprises one of a fiber distribution hub or a network access point.

6. The apparatus of claim 4, wherein the pedestal comprises a pedestal lid and an annular opening, the pedestal lid configured to cover the annular opening.

7. The apparatus of claim 6, wherein one of the pedestal lid or the annular opening comprises a plurality of lateral patch antennas.

8. The apparatus of claim 7, wherein the plurality of lateral patch antennas comprises a plurality of arrays of patch antennas.

9. The apparatus of claim 6, wherein the pedestal lid comprises a leaky planar waveguide antenna.

10. The apparatus of claim 4, wherein the antenna comprises one or more of at least one additional directing element or at least one additional dielectric layer including a plurality of directing elements.

11. The apparatus of claim 4, wherein the antenna comprises one or more of at least one reversed F antenna, at least one planar inverted F antenna ("PIFA"), at least one planar waveguide antenna, or at least one lateral patch antenna.

12. The apparatus of claim 4, wherein the antenna transmits and receives wireless broadband signals according to a set of protocols selected from a group consisting of IEEE 802.11a, IEEE 802.11b, IEEE 802.11g, IEEE 802.11n, IEEE 802.11ac, IEEE 802.11ad, and IEEE 802.11af.

13. The apparatus of claim 4, wherein the antenna transmits and receives wireless broadband signals according to a set of protocols selected from a group consisting of Universal Mobile Telecommunications System ("UMTS"), Code Division Multiple Access ("CDMA"), Long Term Evolution ("LTE"), Personal Communications Service ("PCS"), Advanced Wireless Services ("AWS"), Emergency Alert System ("EAS"), and Broadband Radio Service ("BRS").

14. The apparatus of claim 4, wherein the at least one conductive signal line comprises at least one of one or more data cables, one or more video cables, or one or more voice cables.

15. The apparatus of claim 4, wherein the antenna is in line of sight of one or more wireless transceivers each mounted on an exterior surface of a customer premises of one or more customer premises.

* * * * *